US008256504B2

(12) United States Patent
Brown

(10) Patent No.: US 8,256,504 B2
(45) Date of Patent: Sep. 4, 2012

(54) UNLIMITED STROKE DRIVE OIL WELL PUMPING SYSTEM

(76) Inventor: T. Leon Brown, Amarillo, TX (US)

( * ) Notice: Subject to any disclaimer, the term of this patent is extended or adjusted under 35 U.S.C. 154(b) by 1322 days.

(21) Appl. No.: 11/899,279

(22) Filed: Sep. 5, 2007

(65) Prior Publication Data

US 2008/0314581 A1 Dec. 25, 2008

Related U.S. Application Data

(63) Continuation-in-part of application No. 11/668,252, filed on Jan. 29, 2007, now Pat. No. 8,066,496, which is a continuation-in-part of application No. 11/103,067, filed on Apr. 11, 2005, now abandoned.

(51) Int. Cl.
*E21B 43/00* (2006.01)
*F04B 43/00* (2006.01)

(52) U.S. Cl. ..... 166/68; 166/105; 417/904

(58) Field of Classification Search ..... 166/68, 166/105, 105.2, 75.11; 417/904
See application file for complete search history.

(56) References Cited

U.S. PATENT DOCUMENTS

| | | | | |
|---|---|---|---|---|
| 2,645,899 | A * | 7/1953 | Dwight et al. | 60/372 |
| 3,782,117 | A * | 1/1974 | James | 60/372 |
| 4,024,913 | A * | 5/1977 | Grable | 166/72 |
| 4,195,691 | A * | 4/1980 | Newling | 166/378 |
| 4,512,149 | A * | 4/1985 | Weaver | 60/371 |
| 4,848,085 | A * | 7/1989 | Rosman | 60/372 |

* cited by examiner

*Primary Examiner* — Kenneth L Thompson
(74) *Attorney, Agent, or Firm* — Gable Gotwals

(57) ABSTRACT

An unlimited stroke drive method for pumping fluid from an oil well in which the well has a tubing string extending from the earth's surface down to a fluid producing formation. The method includes the steps of positioning a pump barrel within the tubing, an upper end of the pump barrel having communication through a standing valve with the interior of the tubing string, vertically reciprocating a length of flexible cable within the tubing string to vertically reciprocate a plunger within the pump barrel to allow a lower portion to quickly fill with fluid from the producing formation and then to a downward position in which fluid within the pump barrel lower portion is transferred through a traveling valve to an area within the pump barrel above the plunger to move formation fluid from within the pump barrel to the interior of the tubing and thence to the earth's surface.

10 Claims, 16 Drawing Sheets

UNLIMITED STROKE DRIVE OIL WELL PUMPING SYSTEM

REFERENCE TO PENDING APPLICATIONS

This application is a continuation-in-part application which claims priority to U.S. patent application Ser. No. 11/668,252, filed on Jan. 29, 2007 and entitled "An Improved Reciprocating Pump System For Use In Oil Wells" which in turn is a continuation-in-part application which claims priority to U.S. patent application Ser. No. 11/103,067, filed on Apr. 11, 2005, and entitled "Improved Hydraulic Pump Jack System For Reciprocating Oil Well Sucker Rods".

FIELD OF THE INVENTION

This invention relates to an unlimited stroke drive oil well pumping system for reciprocating an oil well pump located in the bottom portion of a string of tubing in which the pump is reciprocated by a flexible cable extending from the pump to the earth's surface, and an improved rapid fill pump for use in the system.

BACKGROUND OF THE INVENTION

Oil wells typically vary in depth from a few hundred feet to several thousand feet. In many wells there is insufficient subterranean pressure to force the oil to the earth's surface. For this reason some system must be devised for pumping the crude oil from the producing formation to the earth's surface. The most common system for pumping an oil well is by the installation of a pumping unit at the earth's surface that vertically reciprocates a string of sucker rods extending within tubing to a subsurface pump.

Traditionally sucker rod strings have been reciprocated by a device known as a pump jack which operates by the rotation of an eccentric crank driven by a prime mover which may be an engine or an electric motor. Such mechanical drive mechanism has been utilized extensively in oil production industry for decades and continues to be a primary method for extracting oil from a well. However, such mechanical systems suffer from a number of inherent disadvantages or inefficiencies that include their substantial size and weight that makes them expensive to produce, difficult to transport and expensive to install. The mass of such units also requires significant structural support elements at the wellhead which adds to the complexity and expense of the overall drive mechanism. Furthermore, mechanical drive systems have components that are physically linked or connected in some form by way of connecting rods, cams and gear boxes. For a variety of different reasons it often becomes necessary to adjust the travel of the pump rod. Mechanical linkages, as have been previously used, present difficulties in adjusting the travel or displacement of the pumping rods. With most mechanical pumping systems in present use adjusting the rod displacement or pumping speed requires the drive system to be shut down, wasting valuable production time and increasing labor costs. Mechanical drive pump jacks are also limited in their ability to control acceleration and deceleration of the pump rod during its reciprocation.

To combat these limitations in mechanical pump jack drive systems, others have provided a variety of different pneumatic and hydraulic drive mechanisms that have met varying degrees of success. Most hydraulic drive systems in use today are mounted above a stuffing box through which a polished rod extends. Below the stuffing box is a T-fitting so that produced oil is diverted from upward flow within the well tubing to a gathering line that connects to the stuffing box. Stuffing boxes require frequent lubrication. If not constantly lubricated, the packing in stuffing boxes soon wear out resulting in leakage that can spread crude oil to the environment. The invention herein provides an improved hydraulic operated pumping unit that, among other advantages, eliminates the need for a stuffing box.

Another aspect of the present invention is an improved reciprocated pump positioned at the lower end of a string of tubing supported in a borehole, the tubing providing a passageway for moving formation fluid to the earth's surface.

The pump system is formed of a pump barrel positioned in the borehole having an upper and a lower end. The upper end of the pump barrel is in communication with the tubing. A standing valve is positioned adjacent the lower end of the pump barrel and provides a first passageway through which formation fluid flows into the pump barrel.

The pump barrel has an intermediate vent port between the upper and lower ends, the vent port providing a second passageway by which formation fluid enters the barrel.

A tubular plunger is reciprocated within the barrel. The plunger has an upper and a lower end. A traveling valve controls fluid flow through the tubular plunger.

A plurality of individual non-metallic seal rings separated by metallic spacers are positioned on an upper portion of the plunger. The non-metallic seal rings engage the interior cylindrical surface of the pump barrel. The seal rings and metallic spacers are configured to support in substantially leak proof manner the column of formation fluid within the tubing extending to the earth's surface. The non-metallic seal rings and metallic spacers, in sealed relationship with the interior surface of the pump barrel provide a system that substantially isolates the portion of the barrel below the non-metallic seal rings from the tubing pressure there above to thereby allow formation fluid to more freely flow into the pump barrel. That is, by fully supporting the weight of the produced fluid contained within the tubing extending from the pump barrel to the earth's surface, the area below the packing is thereby substantially at the formation fluid pressure so that no fluid pressure exists within the pump barrel to reduce the rate of fluid flow from the formation into the pump barrel. In this way the pump barrel more rapidly fills on each stroke of the plunger to more efficiently and effectively move formation fluid to the earth's surface as the plunger is reciprocated.

Existing technology in the petroleum industry, especially as it is practiced in older oil fields, requires expensive work over rigs to swab wells and try to determine if fluid removal is needed or cost effective. Rods must be hauled to the location by flat bed trucks and run in and out in singles to accomplish actual sucker rod pump tests. In most depleted gas and/or oil wells fluid levels are not high enough to do accurate swab tests. Concepts included in the invention herein have proven that old wells can be increased in production or put back in production and saved from being plugged. The advent of the rapid fill pump has given the industry a new form of secondary recovery. However there is still a need for less labor intensive, expensive and time consuming methods to test and produce wells.

The invention herein addresses and solves problems associated with the shortage of heavy equipment, labor, material and creates an economical way for producers to save marginal wells and to perform maintenance on down hole pumps.

BRIEF SUMMARY OF THE INVENTION

The hydraulic pump jack drive system for reciprocating a down hole oil well pump by means of a sucker rod string, that is the subject of this invention, includes a vertically positioned hydraulic cylinder having a reciprocated piston therein. A cylindrical, polished, piston rod extends from a lower end of the piston and through a bottom seal that closes the lower end of the hydraulic cylinder. The hydraulic cylinder preferably sits above a wellhead that has the lower end thereof connected to a tubing string that extends from the earth's surface downward to a subterranean oil producing formation. The wellhead has an upper end that is connected to the lower end of the hydraulic cylinder. Further the wellhead includes at least one side orifice that is adapted to be connected to a collection line by which crude oil produced by the well can be conveyed to a collection system. This arrangement eliminates the expense of providing a stuffing box that is typically employed with the systems currently used by the oil industry for pumping reciprocated bottom hole pumps. Not only does the system herein eliminate the stuffing box but eliminates the time and expense encountered in keeping a stuffing box properly lubricated and the packing replaced.

The invention herein provides a hydraulic system in which the stroke action can be significantly varied. By controlling the application of hydraulic fluid pressure the sucker rod strings can be raised at a selected rate from a lower to an upper position. At the upper positions the sucker rod strings may be held briefly in a steady state so that if the bottom hole pump is of the type designed to release gas trapped within the pump, ample opportunity is given for the gas release. Thereafter, the hydraulic system may be controlled so that sucker rod string is dropped rapidly to recharge the bottom hole pump and to restart the pumping cycle.

The present invention addresses and solves many of the problems involved in fluid extraction from oil and gas wells with current art pumping systems. The loss of pump capacity due to rod stretch is eliminated. Full stroke of the pump plunger on each stroke prevents debris accumulating in the normally unused upper section of the pump barrel and therefore allows the pump to be unseated without sticking the plunger in the pump barrel. The repair of pumps is reduced when the plunger and barrel can be reused. Well pulling costs are reduced when the pump can be unseated and the tubing flushed without sticking the plunger in the pump barrel. Well pulling rig costs are reduced due to the ability of the invention to long stroke the pump. When needed the rods can be dropped at a velocity equal to a method only possible in current art pumping systems when a pulling rig is used. The present invention makes possible full control of the reciprocating action of the pump including the ability to stop at the peak of the upstroke or any position in the cycle. The present invention can prevent pipeline damage by adjusting or stopping the rate of the sucker rod fall on the down stroke cycle.

In many wells, and stripper wells in particular, the walking beam pumping system cannot run at a slow enough rate. Well pulling and well tubing, rod and pump repair expense is reduced by slowing the rate to four strokes per minute or less in most wells. Electrical power use and maintenance is reduced. Horse power demand is less and power is only needed on the upstroke of the pump. Elimination of the cyclic load created by a walking beam pumping unit on the electric motor results in reduced power factor penalties from electrical utility companies. In stripper wells in particular which produce ten barrels or less per day, the cost of daily operations are reduced. Reduced risk of pipe line leaks, the elimination of stuffing box leaks and no mechanical maintenance reduces the cost of field equipment and employees required to operate wells.

The present invention provides a pumping system which is easily installed on existing wells and is cheaper to operate and maintain. The productive life of all oil and gas wells depend on the economics involved in extracting and delivering the well bore fluids. The apparatus of the present invention includes (a) a hydraulic cylinder connected to the pumping tee; (b) a pump spacing adaptor attached to the cylinder rod; (c) a sucker rod string attached to the spacing adaptor; (d) a hydraulic pump of pre-determined pressure and rate to raise the rod string and load the down hole pump; (e) a means to control the hydraulic flow at the top of the upstroke of the down hole pump; (f) a means to hold the pump at the top of the stroke for a pre-determined time; (g) a means to release fluid back to the hydraulic reservoir and allow the gravity fall of the sucker rod string; (h) a means to regulate the speed of the gravity fall of the sucker rod string on the down stroke; and (i) a means to restart the pumping cycle at a pre-determined time.

The method of the present invention is an improved method using the above described apparatus for oil and gas well fluid extraction, which comprises, hydraulic fluid pumped into the hydraulic drive cylinder at sufficient pressure to raise the cylinder rod and sucker rod to load the down hole pump. When the pull rod of the down hole pump reaches the maximum stroke length of the pump barrel, pressure increases above what is required to lift the rods. An adjustable pressure switch stops the flow of drive fluid at a pre-determined pressure above the string weight, but less than the pressure required to unseat the pump. This insures full stroke of the pump regardless of the rod stretch. The gas venting pump is held at the peak of the up stroke for a pre-determined time to vent gas out of the fluid chamber and facilitate maximum fluid pump efficiency. After a pre-determined time an adjustable time delay opens a solenoid valve and fluid is allowed to flow from the drive cylinder back to the hydraulic reservoir. Gravity and fluid column pressure in the well tubing allow the rods and pump to return to the down stroke position. A variable orifice valve adjusts the speed of the down stroke by holding back pressure on the drive cylinder. The pressure on the drive cylinder is adjusted to remain above the well tubing pressure with an adjustable back pressure valve. This insures that well fluids cannot dilute hydraulic drive fluid. An adjustable electric time delay restarts the hydraulic pump for the next cycle at a pre-determined time.

Another important advantage of the present invention is the provision of a unique system for adjusting the length of the sucker rod string for more efficient actuation of the bottom hole pump.

Another aspect of the present invention is an improved reciprocated pump positioned at the lower end of a string of tubing supported in a borehole, the tubing providing a passageway for moving formation fluid to the earth's surface.

The pump system includes a pump barrel positioned in the borehole having an upper and a lower end. The upper end of the pump barrel is in communication with the tubing. A standing valve is positioned adjacent the lower end of the pump barrel and provides a first passageway through which formation fluid flows into the barrel.

The pump barrel has an intermediate vent port between the upper and lower ends, the vent port providing a second passageway by which formation fluid enters the barrel.

A tubular plunger is reciprocated within the barrel. The plunger has an upper and a lower end. A traveling valve controls fluid flow through the tubular plunger.

A plurality of individual non-metallic seal rings, separated by metallic spacers, are positioned on the plunger. The non-metallic seal rings engage the interior cylindrical surface of the pump barrel and are configured to support in substantially leak proof manner the column of formation fluid within the tubing extending to the earth's surface. The non-metallic seal rings and metallic spacers in sealed relationship with the interior surface of the pump barrel provide a system that substantially isolates the portion of the barrel below the seal rings from the tubing pressure there above to thereby allow formation fluid to more freely flow into the lower portion of the pump barrel. That is, by the use of packing fully supporting the weight of the produced fluid contained within the tubing extending from the pump barrel to the earth's surface, the area below the packing is thereby substantially at the formation fluid pressure so that no fluid pressure exists within the pump barrel to reduce the rate of fluid flow from the formation into the barrel. In this way the pump barrel more rapidly fills on each stroke of the plunger to more efficiently and effectively move formation fluid to the earth's surface as the plunger is reciprocated.

Further objects and features of the present invention will be apparent to those skilled in the art upon reference to the accompanying drawings and upon reading the following description of the preferred embodiments.

BRIEF DESCRIPTION OF THE DRAWINGS

FIGS. 11 and 12 show the boom in the lower position.

FIG. 17 illustrates the versatility of the system of this invention.

DETAILED DESCRIPTION OF THE PREFERRED EMBODIMENTS

Figure 1:
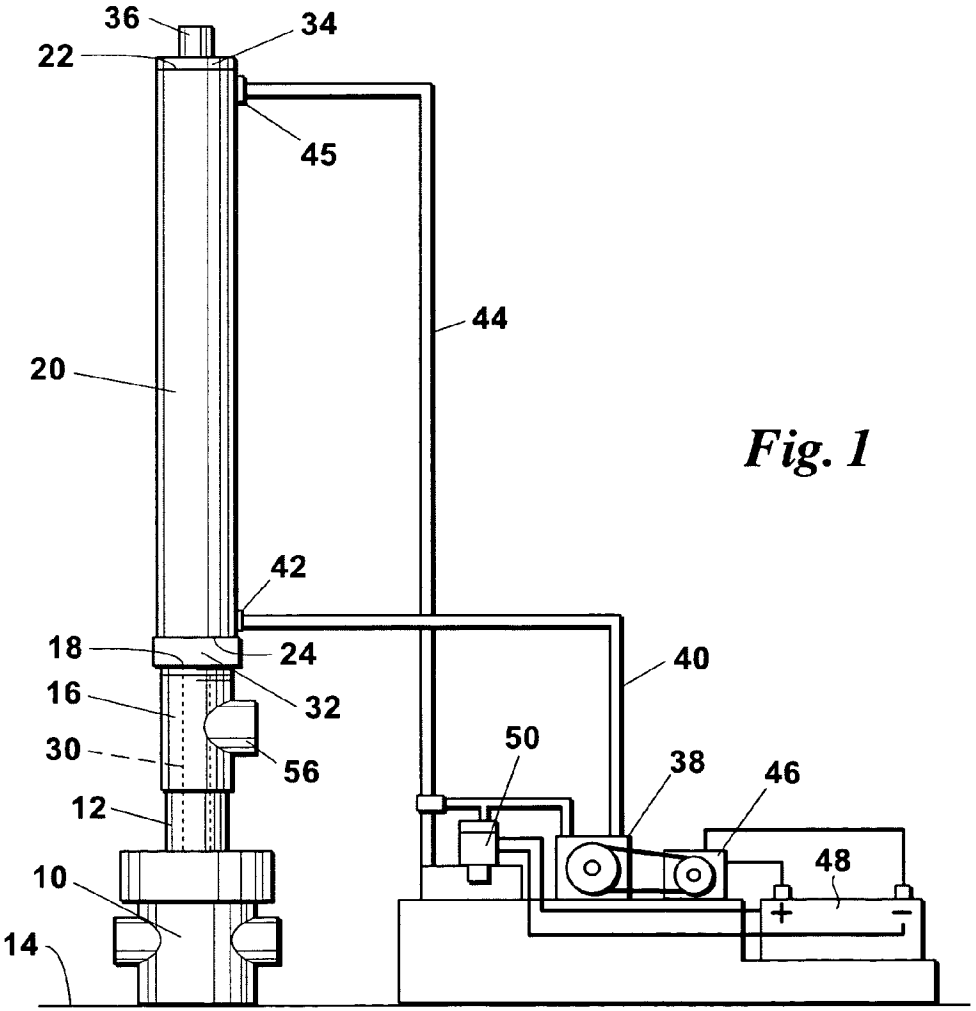
FIG. 1 is an elevational diagrammatic view of a pumping unit according to this invention showing a system for producing hydraulic fluid pressure flow for the actuation of a piston within a cylinder.

It is to be understood that the invention that is now to be described is not limited in its application to the details of the construction and arrangement of the parts illustrated in the accompanying drawings. The invention is capable of other embodiments and of being practiced or carried out in a variety of ways. The phraseology and terminology employed herein are for purposes of description and not limitation.

| Elements shown by the drawings are identified by the following numbers: | |
|---|---|
| 10 | wellhead |
| 12 | tubing |
| 14 | earth's surface |
| 16 | Tee fitting |
| 18 | top of 16 |
| 20 | hydraulic cylinder |
| 22 | top end |
| 24 | bottom end |
| 26 | piston |
| 28 | internal cylinder wall |
| 30 | downward extending piston rod |

-continued

| Elements shown by the drawings are identified by the following numbers: | |
|---|---|
| 32 | seal member |
| 34 | closure member |
| 36 | air vent |
| 38 | hydraulic fluid pump |
| 40 | pipe |
| 42 | inlet opening |
| 44 | return pipe |
| 46 | prime mover |
| 48 | battery |
| 50 | hydraulic controls |
| 52 | string of sucker rods |
| 54 | bottom hole pump |
| 56 | side opening |
| 58 | upwardly extending piston rod |
| 60 | upper seal member |
| 62 | tubular adjustment member |
| 64 | reduced diameter lower end |
| 66 | adjustment rod |
| 68 | adjustment nut |
| 70 | coupling |
| 72 | pump barrel |
| 74 | lower end |
| 76 | standing valve |
| 78 | straining nipple |
| 80 | seating shoe |
| 82 | casing |
| 84 | borehole |
| 86 | closed chamber |
| 88 | perforations in the tubing |
| 90 | perforations in the casing |
| 92 | plunger |
| 94 | center tube |
| 96 | connecting tube |
| 98 | coupling nut |
| 100 | metal plunger |
| 102 | valve seat |
| 104 | ball |
| 106 | passageway |
| 108 | elastomeric cups |
| 110 | metallic spacers |
| 112 | coupling nut |
| 114 | upper plunger traveling valve |
| 116 | seat |
| 118 | valve ball |
| 122 | transition coupling |
| 124 | passageways |
| 126 | tube vent ports |
| 128 | barrel vent ports |
| 130 | cable installation |
| 132 | boom machine |
| 133 | deadline |
| 134 | cable |
| 135 | cable rope socket box |
| 136 | cable drum |
| 137 | top sheaves |
| 138 | hydraulic pump |
| 139 | clamp |
| 140 | hydraulic motor |
| 142 | hydraulic oil tank |
| 144 | control valve |
| 146 | solenoid drive cylinder |
| 148 | solenoid valve |
| 150 | dead line socket |
| 151 | rod elevator |
| 152 | solenoid valve pole cylinder |
| 154 | valve drive cylinder |
| 156 | crown block |
| 158 | upper seal |
| 160 | solenoid valve |
| 162 | check valve |
| 164 | high pressure tank |
| 166 | lower seal |
| 168 | hydraulic oil cavity |
| 170 | pipe |
| 172 | grease gun |
| 174 | beam pumping unit |
| 176 | pumping jack |

-continued

| Elements shown by the drawings are identified by the following numbers: | |
|---|---|
| 178 | block bearing |
| 180 | pumping beam |
| 182 | gear box |
| 184 | shaft |
| 186 | crank arm |
| 188 | counterweight |
| 190 | horsehead |
| 192 | polish rod |
| 194 | stuffing box |
| 196 | tubing |
| 198 | hydraulic cylinder |
| 200 | piston rod |
| 202 | bearing |
| 204 | bearing |
| 206 | pumping unit base |
| 208 | seating nipple |
| 210 | hold down |
| 212 | 1½" pump barrel |
| 214 | plunger tube |
| 216 | on-off tool |
| 218 | pull rod adapter |
| 220 | 1¼" cup or ring plunger |
| 222 | perforated coupling |
| 224 | 1½" to 2¾" change over |
| 226 | 2¾" gas vent pump barrel |
| 228 | gas vent ports |
| 230 | 2¾" metal tubing pump plunger |
| 232 | traveling valve |
| 234 | standing valve |
| 236 | upper traveling valve |
| 238 | plunger tube adapter |
| 240 | plunger tube extension |
| 242 | upper traveling valve |
| 244 | valve case |
| 246 | metal plunger |
| 248 | lower traveling valve |
| 250 | barrel vent ports |
| 252 | internal threads |
| 254 | top of stroke end gland |
| 256 | return port |
| 258 | shaft |
| 260 | opening |
| 262 | collar |
| 264 | washer |
| 266 | sleeve |
| 268 | washer |
| 270 | coiled spring |
| 272 | top washer |
| 274 | rod coupling |

Referring to the drawings and first to FIG. 1, the basic elements making up a system that can be used to practice the invention are illustrated. A wellhead 10 of the type that is typically secured to the upper end of oil well casings is illustrated. Extending upwardly from wellhead 10 is the upper end portion of tubing 12. Tubing 12 is typically supported by slips within the wellhead 10, the tubing 12 hanging downwardly in the wellhead and extending down to a producing formation in the earth which may be from several hundred to several thousand feet below the earth's surface 14.

Affixed to the upper end of tubing 12 is a Tee fitting 16 that has a vertical passageway therethrough. Supported on the top 18 of the Tee fitting is a vertically positioned elongated hydraulic cylinder 20. Cylinder 20 has a top end 22 and a bottom end 24.

Figure 4:
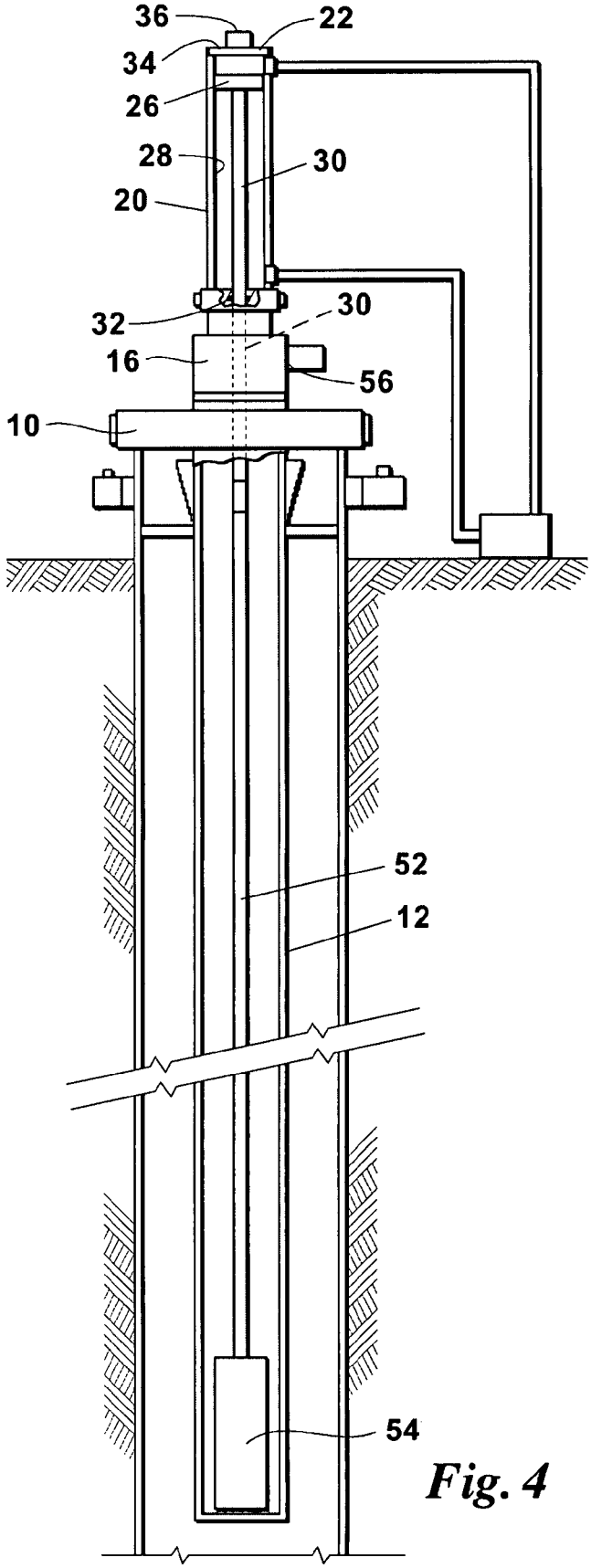
FIG. 4 is an elevational, partial cross-sectional view showing diagrammatically the components making up the system of this invention.

FIG. 4 shows hydraulic cylinder 20 in cross-sectional view and shows a piston 26 that is vertically and slidably displaceable within the internal cylindrical wall 28 of hydraulic cylinder 20. Affixed to piston 26 is a vertical, downwardly extending piston rod 30. Piston rod 30 is shown in dotted outline in FIG. 1.

Closing the bottom end 24 of hydraulic cylinder 20 is a seal member 32 that slidably and sealably receives piston rod 30.

The top end 22 of hydraulic cylinder 20 receives a closure member 34 and in the embodiments of FIGS. 1 and 4 closure member 34 has an air vent 36 therein.

Figure 2:
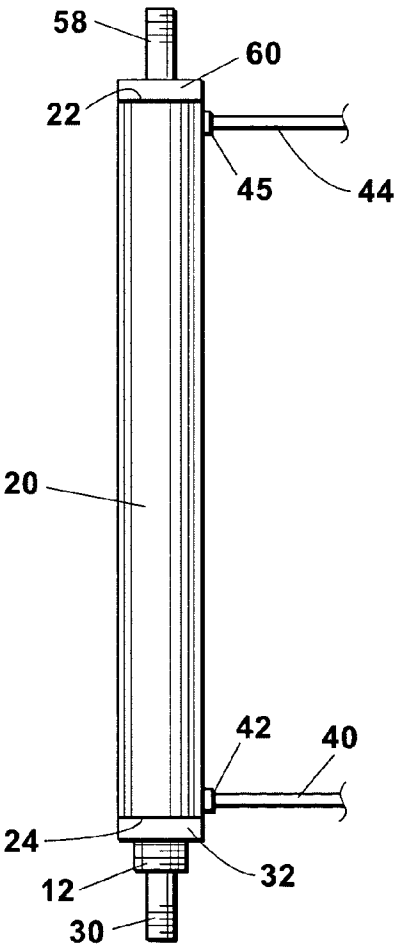
FIG. 2 is an elevational view of the hydraulic cylinder with a piston rod extending therefrom.

As seen in FIG. 1, a hydraulic fluid pump 38 has a high pressure fluid outlet that is connected by pipe 40 to an inlet opening 42 in the cylindrical wall of hydraulic cylinder 20. Also illustrated in FIG. 1 is an optional return pipe 44 that in the embodiments of FIGS. 1 and 2 connects to an outlet opening 45 in the sidewall of cylinder 20. This permits top member 34 to be closed so that air above piston 26 can be circulated back and forth by the hydraulic fluid pump system 38. However, return pipe 44 is optional since it may be eliminated if closure member 34 has an air vent 36 as illustrated in FIGS. 1 and 2. In an alternate embodiment, as will be discussed with reference to FIG. 4, return pipe 44 connects outlet opening 45 in hydraulic cylinder 20 back to the hydraulic fluid pump 38.

The hydraulic system of FIG. 1 includes a prime mover 46, such as an engine or electric motor, by which pump 38 is powered. If prime mover 46 is a motor, energy may be supplied by way of a battery 48 that is representative of any other kind of electrical energy source. In addition, the hydraulic system includes hydraulic control 50 by which the force of hydraulic fluid applied to move piston 26 (as seen in FIG. 4) is controlled. The importance of the hydraulic control 50 will be described subsequently.

Piston rod 30 extending through seal member 32 is attached to the upper end of a string of sucker rods, generally represented by the numeral 52 in FIG. 4. The lower end of the sucker rod string 52 is secured to a bottom hole pump generally indicated by the numeral 54 in FIG. 4. Sucker rod reciprocated bottom hole pumps are well known in the industry and are used for lifting fluid from a subterranean formation upwardly within tubing 12 to the earth's surface. As the fluid is pumped upwardly from the subterranean formation within tubing 12, it enters into the internal passageway within Tee fitting 16. A side opening 56 in the Tee fitting provides a way of channeling the pumped crude oil to a collection line (not shown) by which the produced crude oil may be conveyed to a storage tank or otherwise passed to systems whereby it is ultimately delivered to a refinery for production of diesel fuel, gasoline, lubricating oils and other derivatives.

The seal member 32 at the lower end of hydraulic cylinder 20 confines the produced crude oil to the interior of Tee fitting 16 and thereby eliminates the requirement for a stuffing box. That is, there is no provision needed to seal around piston rod 30 exterior of the hydraulic cylinder 20.

FIG. 2 shows a different embodiment of the invention in which the hydraulic cylinder 20 has a piston therein (not seen in FIG. 2) that has extending downwardly from it piston rod 30 as has been described with reference to FIGS. 1 and 4 and in addition, there is an upwardly extending piston rod 58. That is, in FIG. 2 the piston has a double extending piston rod arrangement—one extending upwardly and one extending downwardly. In this arrangement, an upper seal member 60 is used at the upper end 22 of hydraulic cylinder 20. In the embodiment of FIG. 2 member 60 that closes the upper end 22 of the hydraulic cylinder 20 is a seal member that slidably and sealably receives an upper extending piston rod 58. When the embodiment of FIG. 2 is employed, hydraulic fluid pressure exists within the cylinder above the piston and therefore a return pipe 44 is required. The double rod piston arrangement of FIG. 2 that includes, in addition to the downward extending piston rod 30, the upwardly extending piston rod 58 is important in a closed hydraulic system since the quantity of hydraulic fluid remains constant during the up and down strokes of the piston.

Figure 3:
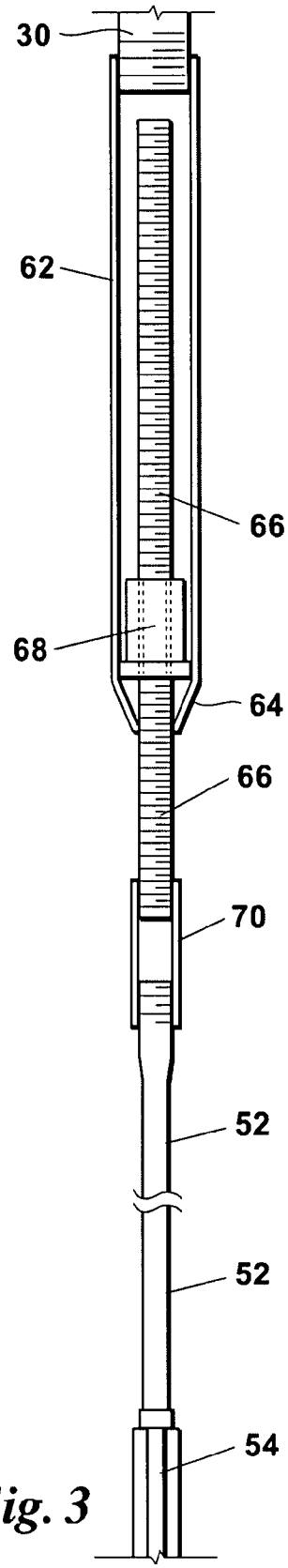
FIG. 3 is an elevational view of the components of the system used to adjust the length of the sucker rod string to more effectively accommodate a bottom hole pump.

It is important that the length of the sucker rod string 52 as seen in FIG. 4 be adjustable for the accurate positioning of bottom hole pump 54. FIG. 3 illustrates a system for adjusting the length of sucker rod string 52.

FIG. 3 shows a vertical tubular adjustment member 62 secured to the lower end of piston rod 30. The tubular adjustment member 62 has a reduced internal diameter open lower end 64 that receives an externally threaded adjustment rod 66. Within tubular adjustment member 62 is an internally threaded adjustment nut 68. By the threadable position of adjustment nut 68 on adjustment rod 66, the effective length of the sucker rod string 52 can be varied. A coupling 70 is threadably attached at the lower end of adjustment rod 62 and to the upper end of sucker rod string 52.

As previously stated, the pumping system of FIG. 1 includes a hydraulic control system 50. This enables the pumping unit to be operated in a manner to make most effective use of the down hole pump 54 that is being employed. For instance, down hole pump 54 may be of a gas release type in which case the hydraulic control system 50 will be regulated so that hydraulic fluid is supplied from hydraulic pump 38 by way of pipe 40 to the lower surface of piston 26 in such a way that the piston is raised at a pre-determined rate of speed which can be relatively constant. The upward movement of piston 26 lifts piston rod 30 and thereby sucker rod string 52 and a plunger (not shown) in bottom hole pump 54, all in an upper direction. When piston 26 reaches the upper end of its stroke as seen in FIG. 4, the hydraulic control system 52 may be regulated such that the piston movement pauses before a downward stroke is commenced. The length of this pause can be adjusted by the system 50. Further, the hydraulic system may be programmed so that the downward movement of piston 26 occurs at a much faster rate than the upward movement. The downward movement rate can be as fast as the fall rate of the sucker rod strings. After the sucker rod string, piston rod and piston have reached their lower downward limit then the upward cycle can begin with or without a delay. Thus, in a preferred way, the pumping cycle applied to bottom hole pump 54 can be carefully regulated to match the requirements of the pump.

Thus, it can be seen that the pumping system herein is more economical than the typical hydraulic pumping system used for reciprocating sucker rod strings in that the need for a stuffing box is eliminated and the need for the constant repair and lubrication of the typical stuffing box is eliminated. Further, the pumping system includes provision for regulating the length of the sucker rod to accurately position the down hole pump in a well and the pumping cycle of the system can be regulated to match the characteristics of the particular down hole pump being employed.

Figure 5:
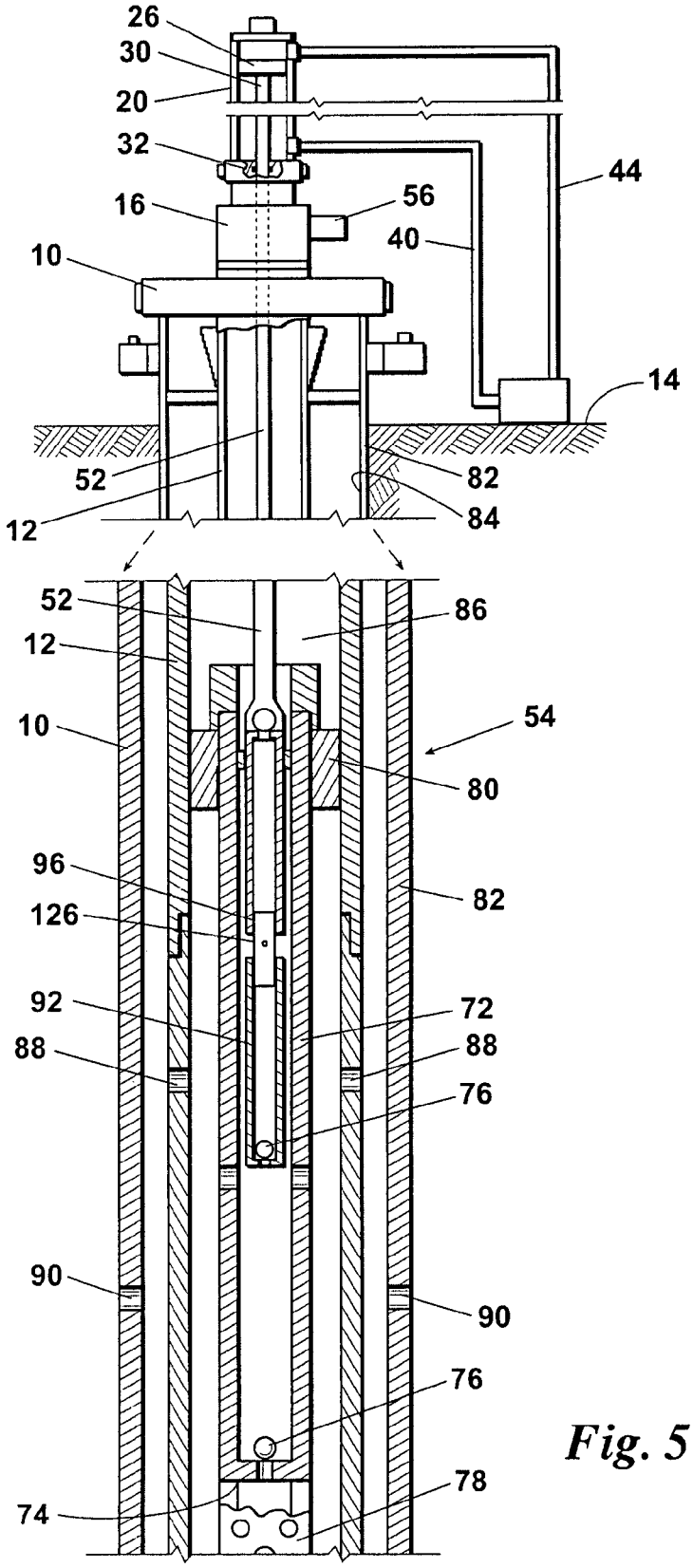
FIG. 5 is a diagrammatic cross-sectional view of the basic elements of a pumping system of this invention having means to facilitate more rapid entry of formation fluid into a pump barrel on each stroke of a pump piston.

An improved bottom hole pump generally indicated by the numeral 54 is shown diagrammatically in FIG. 5. The improved bottom hole pump includes a pump barrel 72 having, adjacent a lower end 74, a standing valve 76. Typically a straining nipple 78 is fitted to the lower end of the pump barrel. Formation fluid flows through the straining nipple 78 and standing valve 96 into the interior of the pump.

Pump barrel 72 is typically anchored within a lower end portion of tubing 12 by a seating shoe 80, shown diagrammatically in FIG. 5. Seating shoe 80 seals against the interior of tubing 12 and the exterior of pump barrel 72.

The function of pump 54 is to move production fluid, such as crude oil, from an area within the earth's surface that is penetrated by a borehole that receives casing 82. Casing 82 is received in a borehole that has been drilled into the earth's surface 14 down to porous rock or sand (not seen) that has therein useful fluids, such as crude oil.

Thus the seating shoe 80 supporting pump barrel 72 forms the bottom end of a closed chamber 86 within tubing 12 that extends from pump 54 to the earth's surface. The function of pump 54 is to move fluid from the producing formation into this closed chamber 86 so that fluid therein gradually moves upward to the earth's surface 14 and ultimately out through side opening 56 in Tee fitting 16. Note that tubing 12 is perforated, that is, it has holes therein indicated by the numeral 88. These perforations allow formation fluid to flow from within casing 10 into the interior of tubing 12 below seating shoe 80. Casing 82 in like manner has perforations 90 to allow production fluid to flow therethrough.

Figure 6:
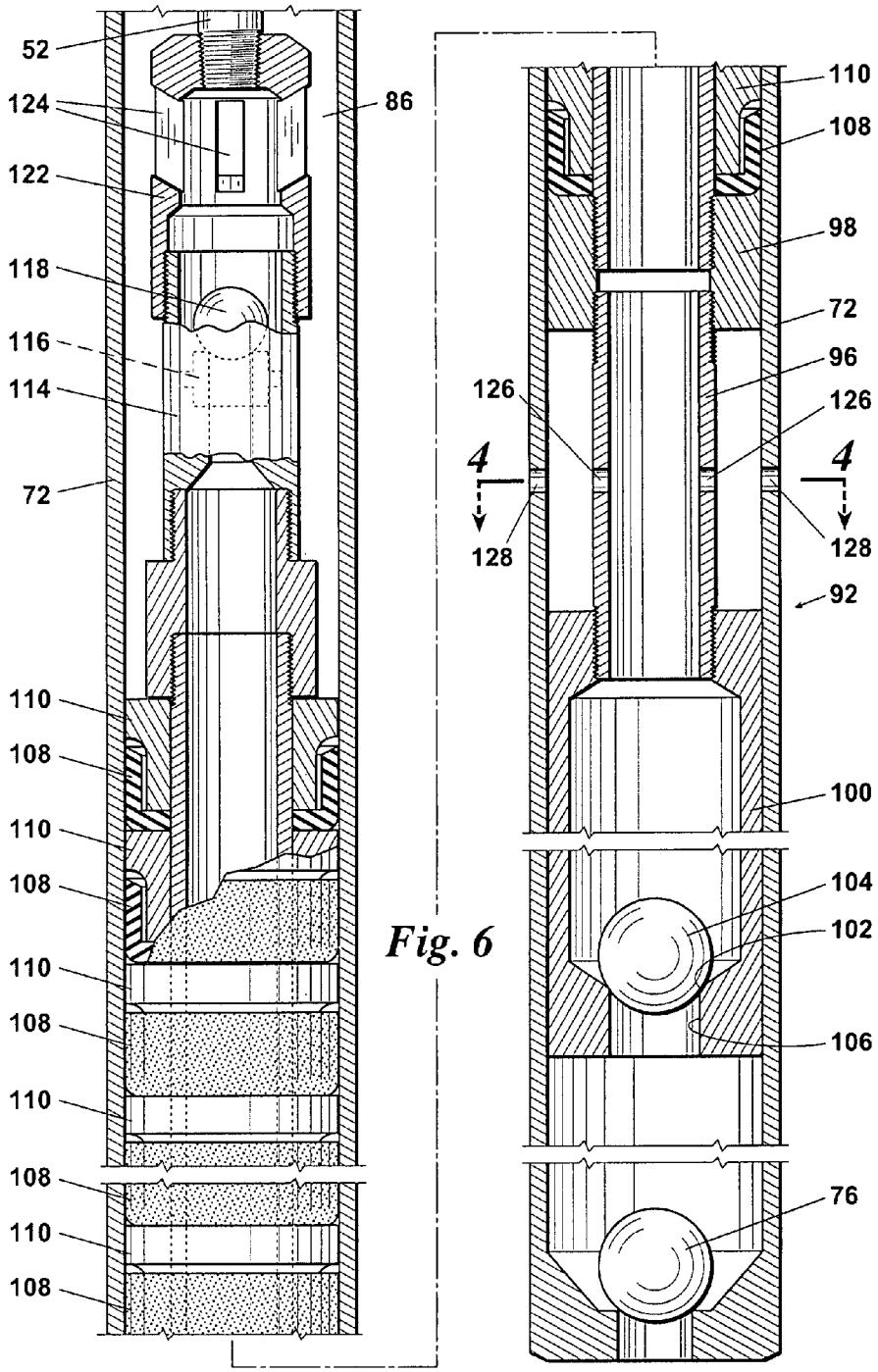
FIG. 6 is an exploded, more detail, view of the improved pumping system of the invention. The illustrated pump has means to fully and completely support a column of fluid extending from the pump to the earth's surface. In this way the fluid column is isolated from the interior of the pump barrel to more effectively and efficiently permit formation fluid flow into the pump barrel on each stroke of the reciprocated pump.

While the bottom hole pump 54 is shown diagrammatically in FIG. 5, FIG. 6 shows more representative details of a typical pump that conforms with the principals of this invention. In FIG. 6 the casing and tubing of the well are not shown and pump barrel 72 is shown with upper and lower portions. Received within pump barrel 72 is a plunger generally indicated by the numeral 92, the plunger also being shown with upper and lower portions. Plunger 92 includes an upper center tube 94 and a connecting tube 96. The tube portions 94 and 96 being in axial alignment and secured end-to-end by a coupling nut 98. Coupling nut 98 is slidably received within pump barrel 72.

Secured to a lower end of connecting tube 96 is an elongated metal plunger 100 that includes a valve seat 102 and a ball 104 that form a lower plunger traveling valve. The lower traveling valve functions, on a down stroke of plunger 92, to permit formation fluid to pass through the valve passageway 106 to enter into the interior of metal plunger 100. The interior of metal plunger 100 communicates with the interior of connecting tube 96 and center tube 94.

Received on the upper center tube 94 are a plurality of alternating elastomeric cups 108 and metallic spacer 110. The exterior diameter of the metallic spacers 110 is slightly less than the interior diameter of pump barrel 72. The elastomeric cups 108 are slightly radially expandable to closely seal against the interior surface of pump barrel 72. This positive sealing contact with the pump barrel serves to support the liquid column within the interior of tubing 12, that is the fluid column formed by closed chamber 86. Thus the liquid column 86 is confined permitting liquid escape from the column only as the liquid is moved upwardly through the tubing to pass out the upper end of the tubing through Tee fitting 16 and side openings 56 as seen in FIG. 5.

The metal plunger portion 100 of the overall plunger 92 is of a length approximately that of the upper portion of the plunger having elastomeric cups 108 and metallic spacers 110. The exact proportional relationship of the length of these two components of pump 54 are not critical. That is, the upper portion of pump 54 having metallic spacers 110 and the elastomeric cups 108 can be either greater or less than the length of metal plunger 100.

As previously stated the external diameter of metal plunger 100 is substantially equal to but slightly less than the interior diameter of barrel 72. The metal-to-metal relationship between metal plunger 100 and barrel 72 does not need to be a perfectly leak proof relationship since the function of metal plunger 100 is not to support the fluid column extending above the pump to the earth's surface but instead is to provide for fluid displacement within the barrel. The portion of the pump that includes metal plunger 100 is essentially a compression chamber. On a down stroke, the metal plunger 100 displaces the area within the barrel to cause movement of fluid past the traveling valve created by ball 104 and seat 102 and into the interior of the plunger so that the fluid that moves therein is vertically transported upwardly upon an upper stroke of the plunger to the earth's surface. In the illustrated arrangement of FIG. 6, the plunger traveling valve accomplished by ball 104, seat 102 and passageway 106 are shown as being integral to a lower portion of the metal plunger 100. This is by way of illustration only as in the actual practicing of the invention this traveling valve is formed of a separate device that is threaded onto the lower end of metal plunger 100.

As seen in the left hand portion of FIG. 6, the upper end of center tube 94 has attached thereto a coupling nut 112 that provides a surface for the capture of the elastomeric cups 108 and metal spacers 110 in a compressed arrangement. Secured to an upper end of coupling nut 112 is an upper plunger traveling valve 114. This traveling valve includes, as shown in dotted outline, a removable seat 116 and partially in solid outline a valve ball 118. This upper plunger traveling valve 114 permits fluid to flow from within the interior of the plunger upwardly through a transition coupling 122 that, on its lower end is affixed to upper traveling valve 114 and at its upper end to the lower end of sucker rod string 52. This transition coupling has passageway 124 in the sidewall thereof by which fluid flows from the interior of the plunger into the closed chamber 86. The seating shoe 80 shown on the exterior of pump barrel 72 in FIG. 5 is not shown in FIG. 6. This seating shoe 80 connects the pump barrel to the interior of the tubing so that fluid pumped out the upper end of the pump barrel through passageways 124 enters into the lower end of the tubing for transfer upwardly through the tubing to the earth's surface.

An important aspect of this invention is illustrated in the right hand portion of FIG. 6. This is the provision of vent ports 126 in connecting tube 96. These vent ports 126 function in cooperation with barrel vent ports 128. As previously stated, with respect to FIG. 5, pump barrel 72 is primarily filled with formation fluid by fluid flow through straining nipple 78 and standing valve 76 into the interior of pump barrel 72. On the downward stroke of plunger 92 this production fluid flows into the interior of the plunger through traveling valve 102, 104. On the upward stroke of the plunger, standing valve 76 closes so that fluid captured in the pump barrel 72 and within the interior of plunger 92 is moved out the upper end of the barrel and into the closed chamber 86 that is in communication with the lower end of tubing 12 as seen in FIG. 5.

To provide a supplemental passageway for production fluid to enter pump barrel 72 and ultimately into the interior of plunger 92, barrel vent ports 128 are provided.

Figure 7:
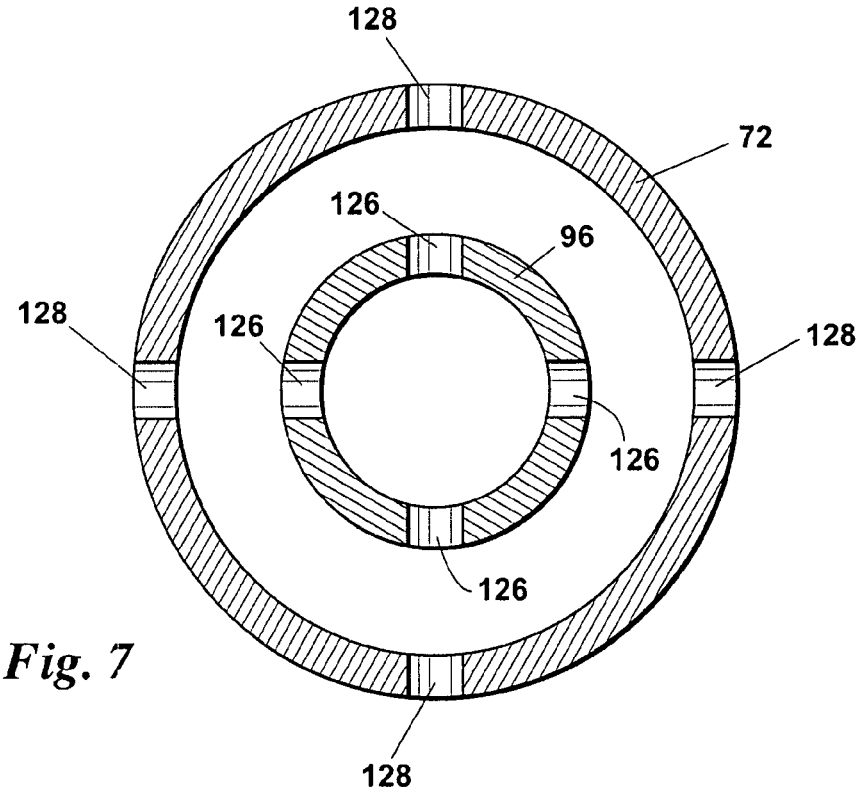
FIG. 7 is an enlarged cross-sectional view taken along the line 7-7 of FIG. 6 showing perforations in the pump barrel that allows flow of formation fluid into the interior of the pump barrel. Further, this view shows perforations in the pump tubular plunger which allows fluid flow into the interior of the plunger. After entering into the interior of the tubular plunger fluid is forced out of the traveling valve at the upper end of the plunger and into the interior of the tubing for ultimate transportation to the earth's surface.

FIG. 7 is a horizontal view taken along the lines 7-7 of the right hand portion of the pump shown in FIG. 6 and shows the tube vent ports 126 and the barrel vent ports 128 in the same plane. This relationship of tube vent ports 126 and barrel vent ports 128 occurs instantaneously on each upstroke and down stroke of the plunger and preferably at or adjacent to the upward end of the upstroke of the pump plunger. In this relative position of the plunger in the pump barrel additional production fluid can flow from the interior of the barrel into the interior of the plunger and simultaneously production fluid can flow from the formation into the interior of the barrel so as to more expeditiously supply fluid to the interior of the plunger to be upwardly moved into the interior of the tubing for transportation to the earth's surface.

In order for the pump barrel and the pump plunger to most expeditiously fill on the upward stroke of the pump plunger it is important that the pressure within the pump barrel below the plunger does not exceed the pressure of the fluid surrounding the pump barrel, that is, the formation fluid pressure. Obviously if the pressure inside the barrel and the plunger are greater than that outside the barrel and the plunger, then fluid will not flow into these areas. Therefore, it is important and a critically unique feature of the present invention to maintain fluid pressure within the plunger and within the barrel as low as possible for more rapid filling of the pump. The pressure within the barrel and within the plunger is materially affected by any pressure leakage within the barrel in response to the fluid pressure above the pump plunger. That is, the pump plunger must fit the barrel with such precision that the high fluid pressure of the fluid column within the tubing, which pressure rests upon the fluid within the upper end of the pump piston, is not permitted to leak past the upper portion of the pump plunger. For this reason an important aspect of the present invention is the provision of the pump plunger having two distinct portions, that is, an upper portion that has on the plunger external surface a plurality of spaced apart elastomeric cups 108 supported in position by metallic spacers 110. The metallic spacers 110 are arranged to support the cups 108 but nevertheless allow the cups to radially expand outwardly into sealing contact with the internal cylindrical surface of the pump barrel. Thus as the pressure of fluid within the tubing extending from the pump to the earth's surface is increased, the force tending to outwardly radially expand the elastomeric cups increases to thereby prevent or at least substantially reduce leakage of fluid from the tubing into the interior of the pump barrel.

A typical bottom hole pump is reciprocated several times per minute in the process of pumping oil to the earth's surface. Each reciprocation of the pump plunger moves only a small quantity of formation fluid into the barrel and upwardly into the column of fluid within the tubing. Therefore any increase in the amount of fluid moved with each stroke of the pump is significant. If a well is pumped for several hours the number of strokes pumped becomes a large significant number and if each stroke of the pump produces only a small increase in the quantity of fluid lifted then the end result becomes very significant. The present invention improves pumping efficiency in two ways. First, a pump is provided having a plunger with two distinct areas, that is, an upper portion and a lower portion and in which the upper portion is provided with elastomeric cups to more effectively seal against the internal wall of the pump barrel and prevent leakage of fluid and pressure of the fluid column within the tubing from communicating with the lower portion of the pump barrel. The second improvement is the provision for more rapidly and efficiently filling the barrel and the pump plunger on each stroke of the pump.

The pumping system described with reference to FIGS. 1 through 4 provides a means of reciprocating a down hole pump, such as a rapid fill pump illustrated in FIGS. 5 though 7 in which pump action is transferred from the earth's surface down hole to the pump by means of a string of sucker rods. Sucker rods are at the present time and have for many years been the primary way of transferring reciprocal action down hole to a pump. However, sucker rods have many disadvantages when it comes to repairing and maintaining an oil well. For this reason there is increased interest in reciprocating a down hole pump with a flexible cable. FIGS. 8 through 15 show improved means of using a flexible cable in place of sucker rods for activating reciprocal down hole pumps in the petroleum industry.

Figure 8:
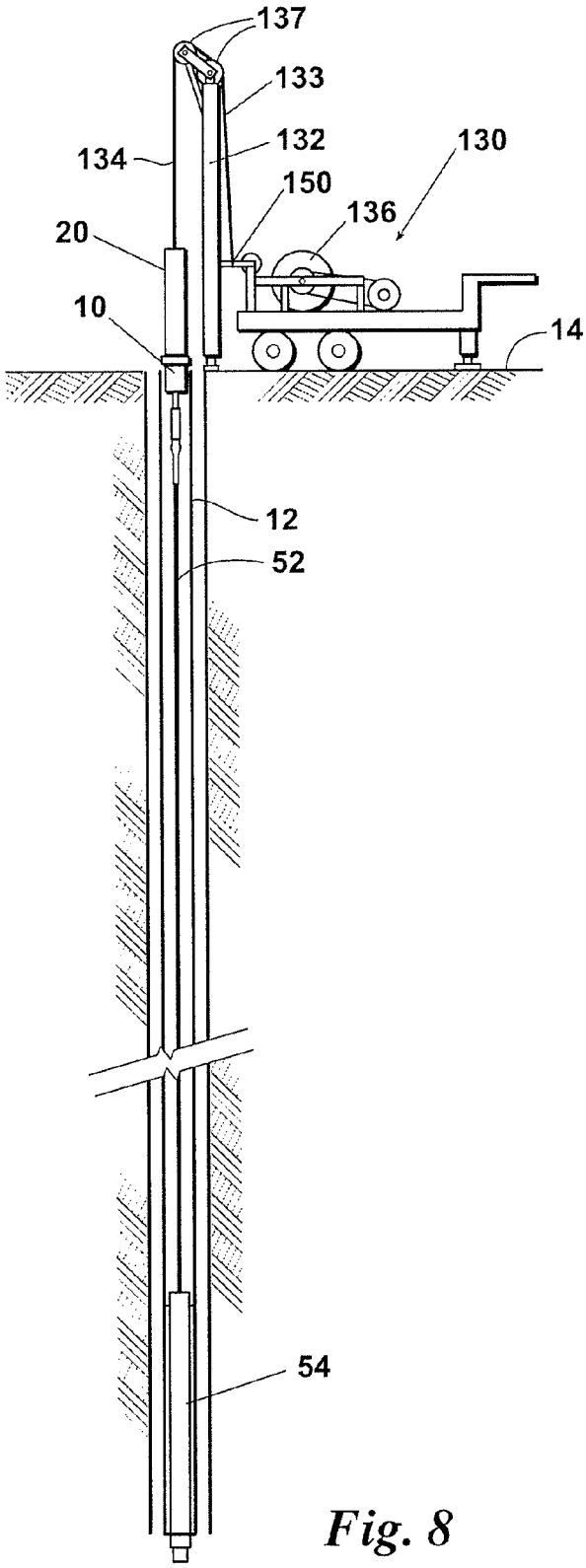
FIG. 8 illustrates schematically the unlimited stroke drive oil well pumping system of this invention as it employs a single drum in the arrangement for changing pumps within an oil well.
Figure 10:
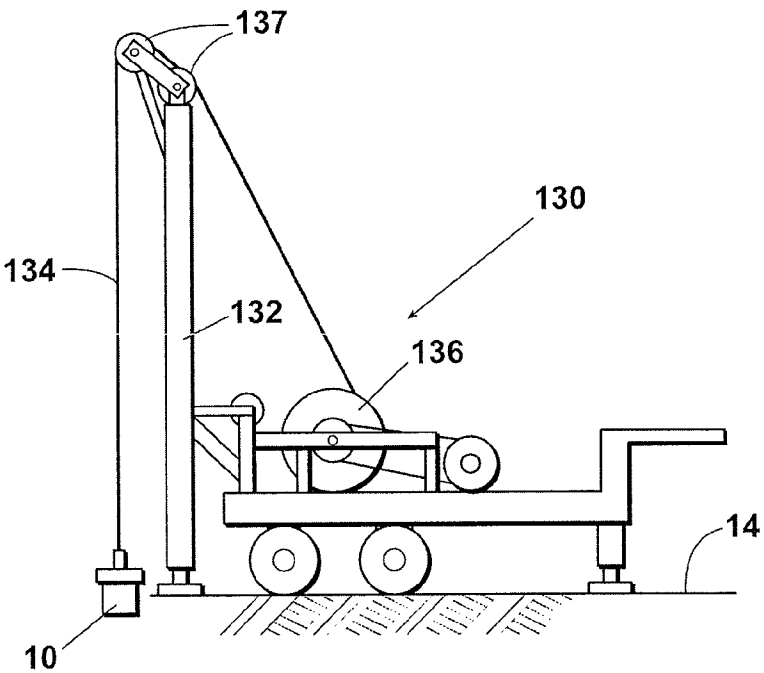
FIG. 10 shows the arrangement of the system wherein the boom is in the lower position and where the flexible line has been tied off to the reel.
Figure 9:
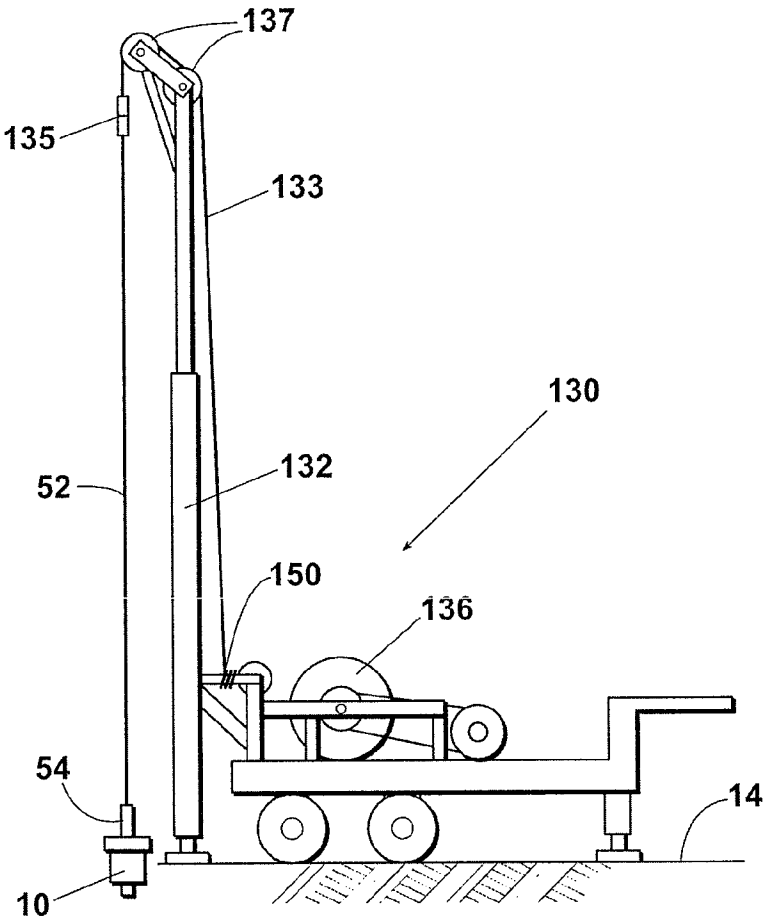
FIG. 9 is similar to FIG. 8 except that in this figure the boom has been elevated to its full height showing how the system can be changed according to the job to be performed.
Figure 12:
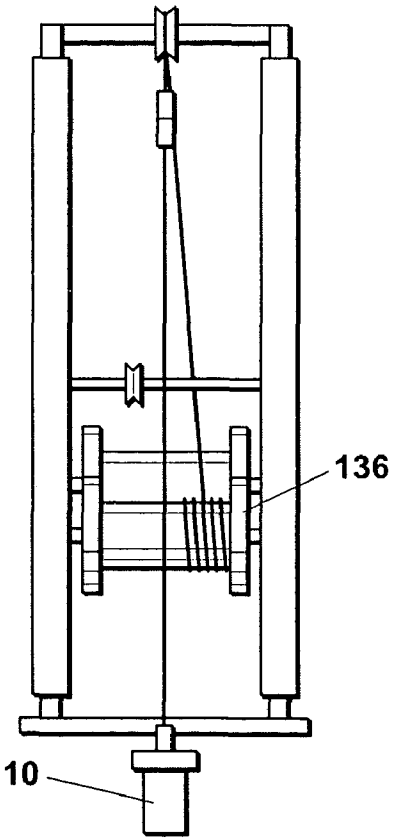
FIG. 12 is an end view of the double drum system of FIG. 11. Both
Figure 11:
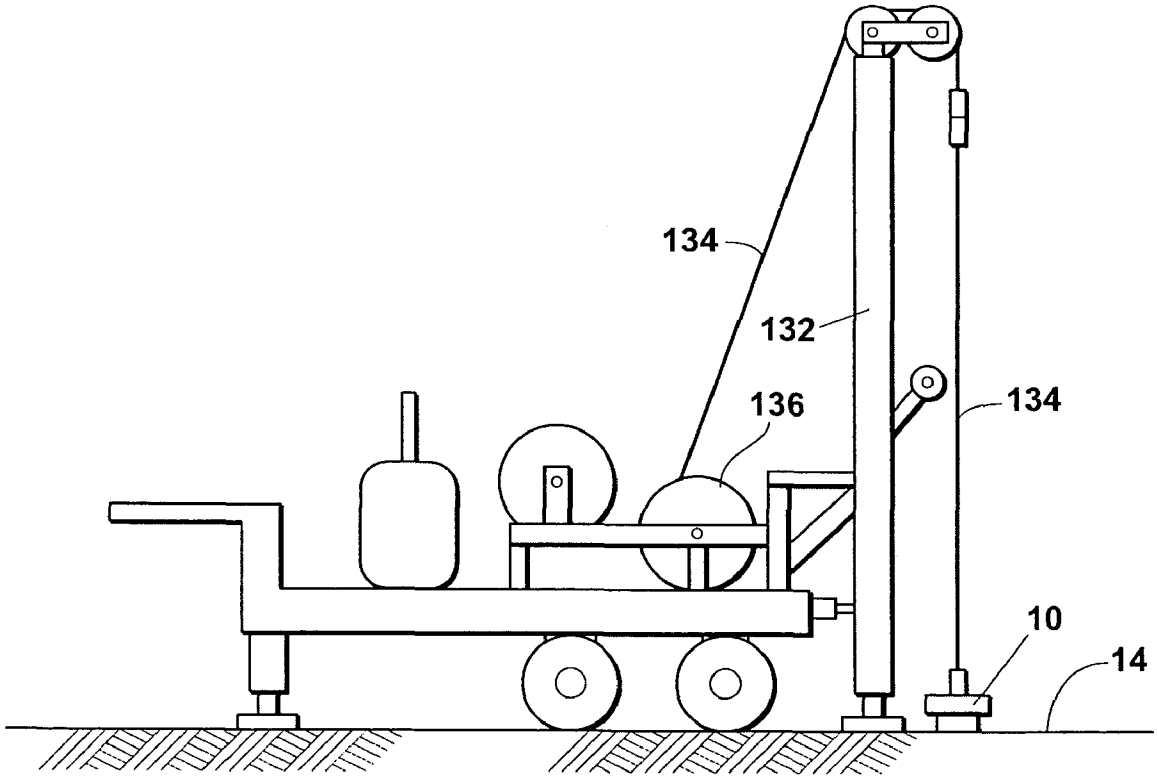
FIG. 11 shows diagrammatically the use of a double drum system in practicing the invention with the boom in the lower position.
Figure 14:
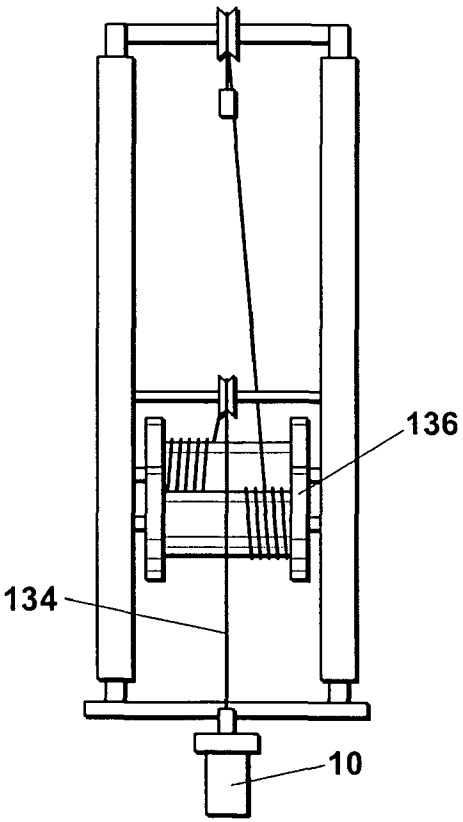
FIG. 14 is an end view of the arrangement of FIG. 13.
Figure 13:
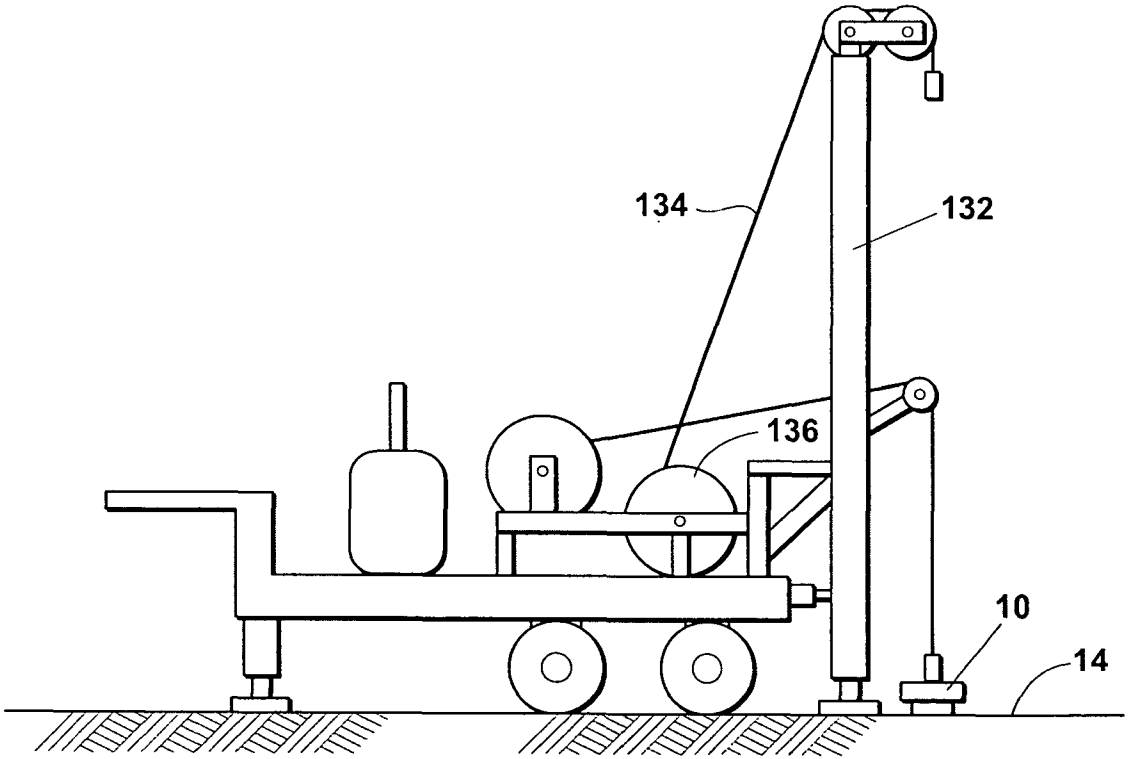
FIG. 13 shows the side view of the double drum system with a flexible line from the second drum extending over an ancillary pulley.
Figure 16:
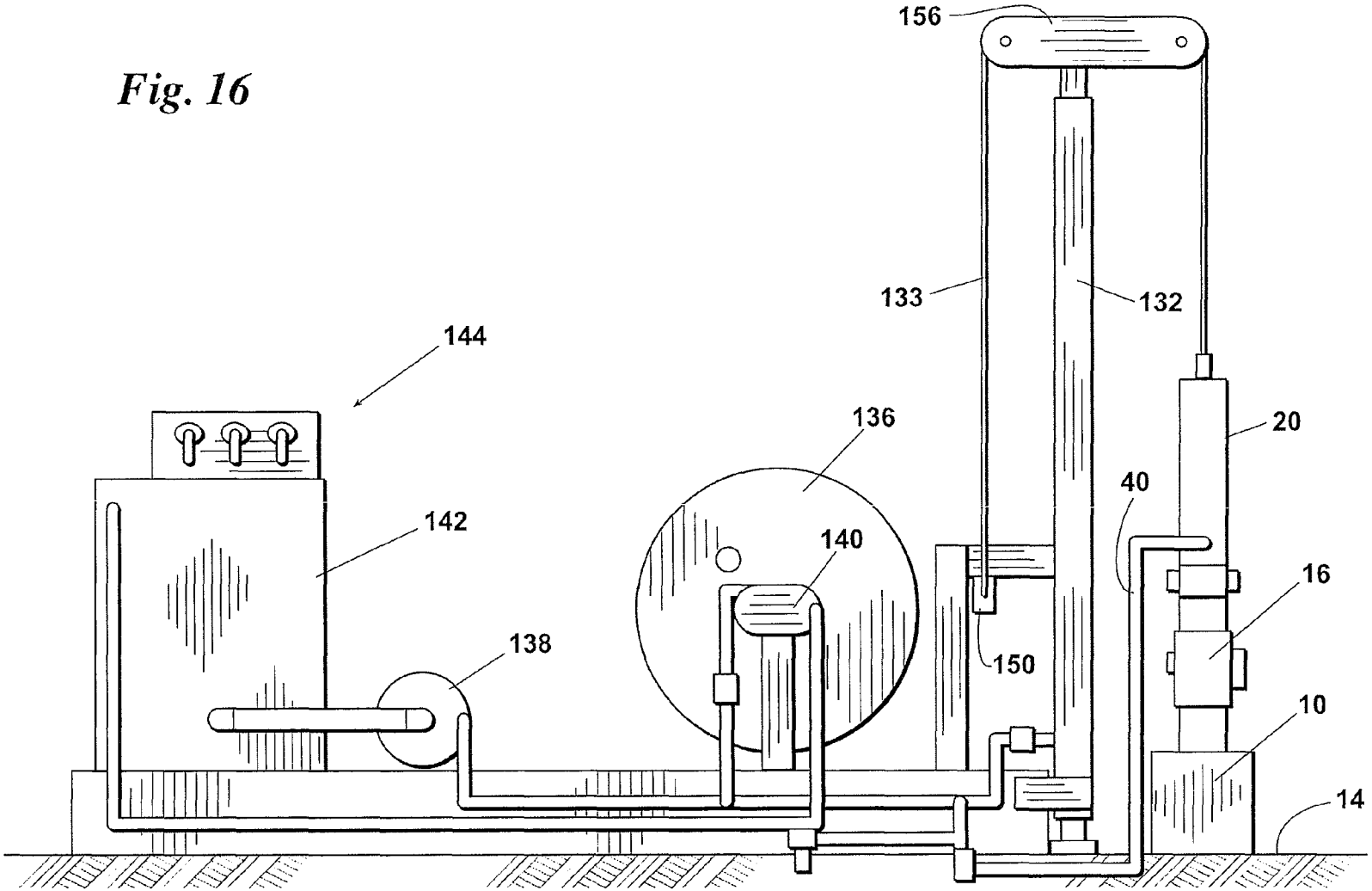
FIG. 16 shows a hydraulic oil tank that functions as a reservoir for the hydraulic system.
Figure 17:
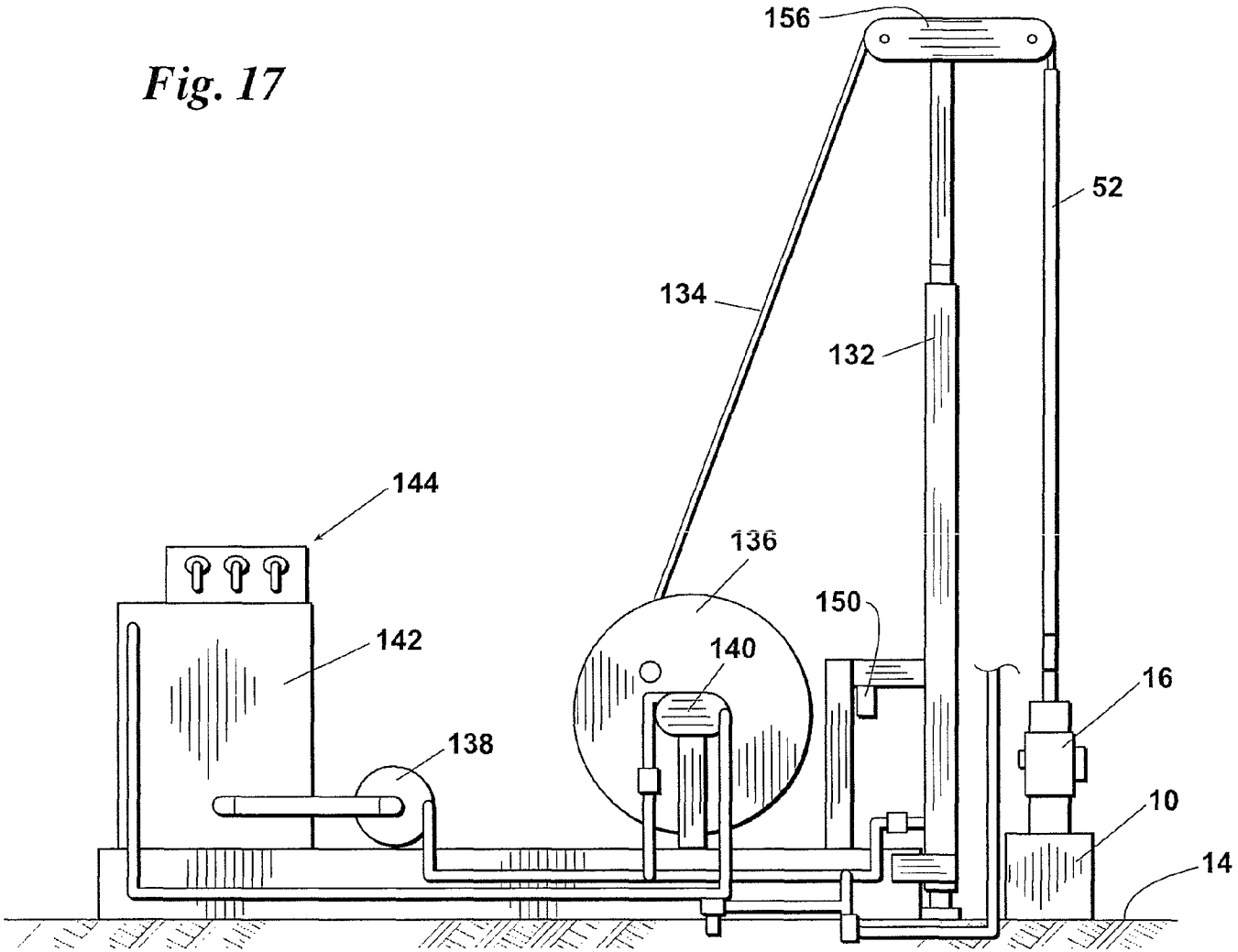
FIG. 17 shows the boom raised to the maximum height which permits installation of sinker bars and pump that may total 25 feet in length.

FIG. 8 is an example of a complete well bore with a cable installation machine 130 that is an important part of this invention. The cable installation machine 130 can be operated by one person to transport the cable to the location of a producing oil well. The cable installation machine 130 includes a boom 132 that is about 18 feet long when retracted and extends to a maximum of approximately 30 feet. Standard pumps and sinker bars are a maximum of about 25 feet so to install these items the boom 132 is extended as seen in FIG. 9. Since the cable 134 applies no weight to the pump (not seen in FIG. 9), weight is needed to force the pump plunger down against the pressure existing on the pump traveling valve, that is, to overcome the fluid weight to surface plus required flow line pressure to the tank. In an example of the application of this invention a 1½" by 10 foot down hole pump and 3½" by 25 foot sinker bars are lowered into the hole. The boom 132 is then retracted to the condition that is seen in FIG. 10. Cable 134 is attached to the last sinker bar with a rod hook shear tool of the type designed by Harbison-Fischer. This is a commonly used item in the petroleum industry when running fiberglass rods. The cable is reeled in the well bore on the low pole as seen in FIG. 10. The sheer in this example is about 15,000 pounds which is about half the rated pull strength of the desired cable to be used.

It is important that the sheer tool is designed so that upon the application of excess stress it will part and thereby protect the cable from being stretched beyond the breaking point. In the event a pump is stuck in a seating nipple or when a pump cannot be pulled from its location at the bottom of a string of tubing due to the accumulation of paraffin, the sheer tool allows the cable to be reeled out of the hole and back on to the cable drum 136. A slick line will pull through even heavy paraffin and avoid or stop what is known as rod stripping jobs. The pump is spaced and the cable marked for cutting. The cable is cut and attached to the drive cylinder with a non-sheering rope socket and swivel that exceeds the pull strength of the cable. The drive cylinder is set on the pumping Tee.

Since the advent of the sucker rod driven plunger pump for artificial lift, pump maintenance has not been an option. Prior art methods involve heavy equipment and labor which is not readily available and is cost prohibitive. The main cause of wells being shut down or plugged is the pulling costs. Increasing expense and shortage of equipment and labor is a major concern in the petroleum industry and contributes to thousands of stripper wells being down waiting for pulling units or other rigs by which they can be repaired and restored to productive use.

The backlog of shut-in marginal wells grows larger everyday as they are left down to move equipment to higher producers. In the state of Oklahoma a number 1 untapped natural resource is the huge number of marginal wells that have been abandoned within the state. The Oklahoma Marginal Well Commission was established to search for new means to keep wells productive. The system disclosed herein can help get these marginal wells back on production and keep them producing.

Figure 18:
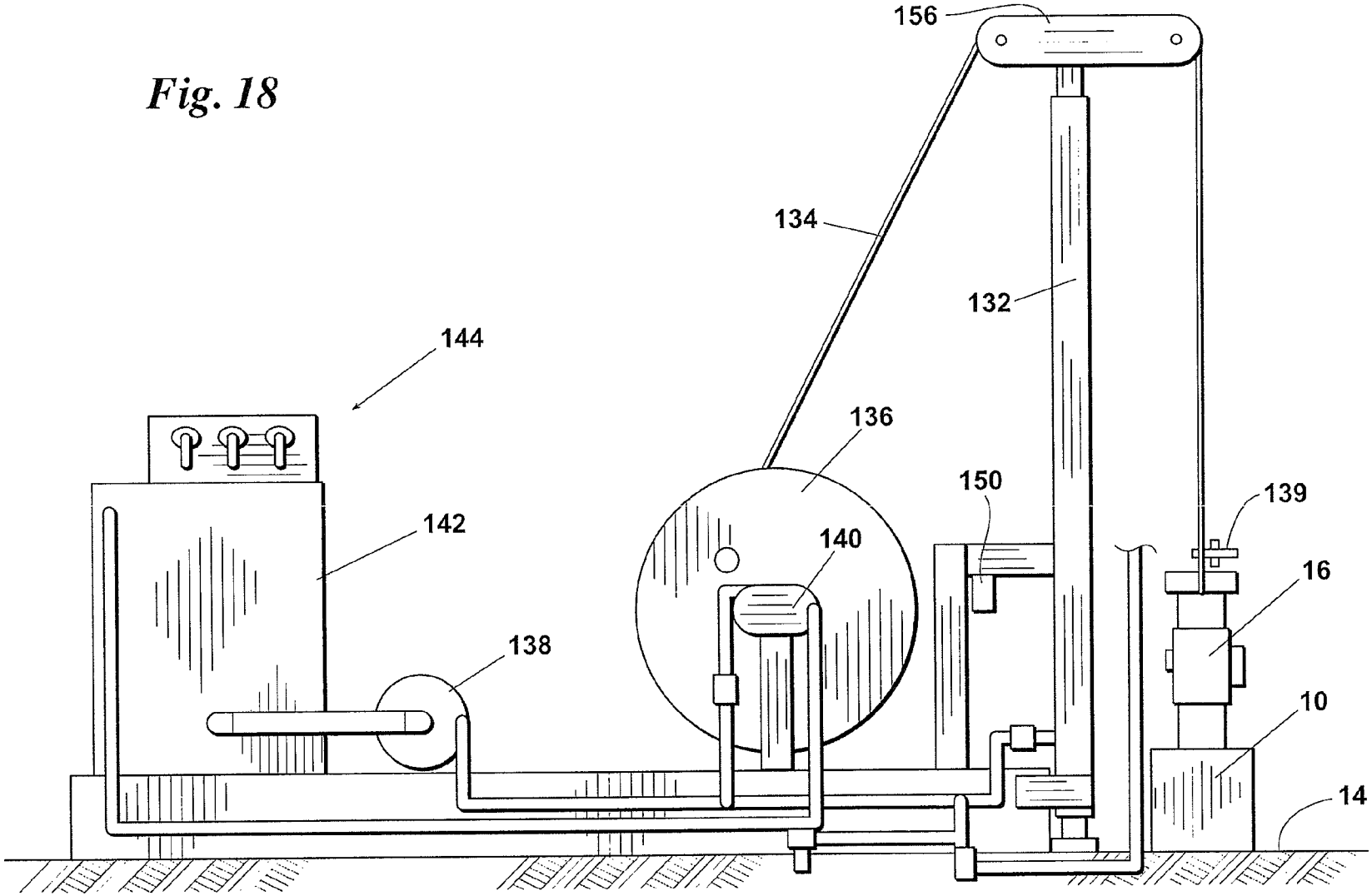
FIG. 18 shows the boom retracted with a flexible line run over the crown that is supported at the upper end of the boom.
Figure 19:
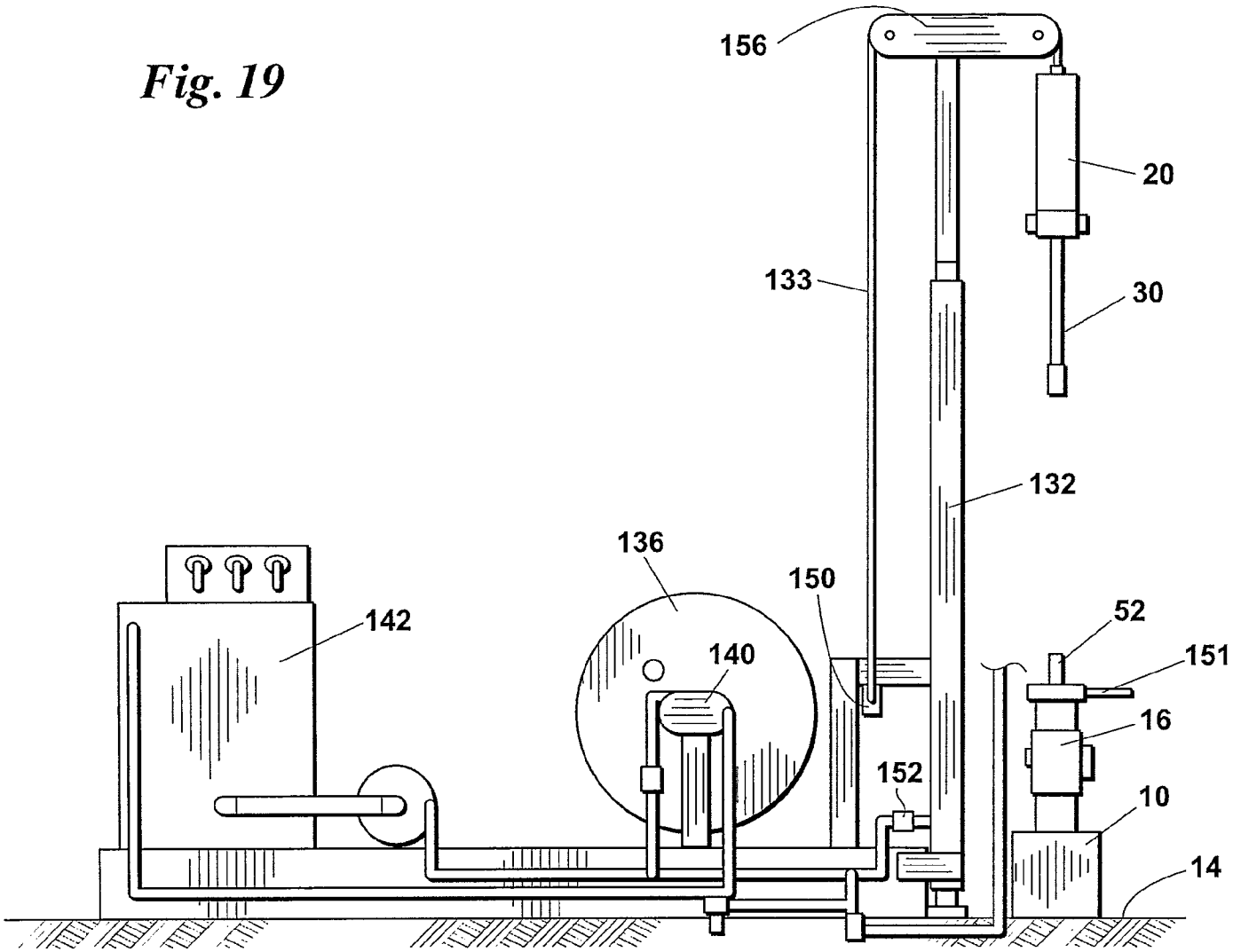
FIG. 19 shows the system as arranged for a pump change with the drive cylinder used for pumping action removed from the wellhead.

In FIG. 8 the drive cylinder 20 is removed from the wellhead 10 by extending the pole 132 against a deadline socket 150. The drive cylinder 20 is laid down and deadline 133 is screwed onto a cable rope socket box 135. With the deadline 133 attached to the socket 150, the pole 132 is extended as shown in FIG. 9. The weight to lift well fluid and unseat the pump 54 is exerted on the pole 132 when it is in its strongest position. When the pump 54 unseats the tubing is allowed to drain thereby decreasing the weight substantially. The pole 132 is extended, lifting the weight of the cable 134 and tools only to a height sufficient to reach the cable spool 136. The cable 134 is clamped off by a clamp 139 at the wellhead 10 (see e.g. FIG. 18) and the pole 132 is lowered to its retrieved position as shown in FIG. 10. The dead line cable 133 is removed and the well cable 134 is run over the top pulleys 137 on the pole and the rope socket box 135 is anchored through the cable reeler 136. The well cable 134 is released at the wellhead 10 and the cable, sinker bars and pumps are reeled out of the hole in minutes. The pole 132 is extended to full height as shown in FIG. 9 and sinker bars and pumps are laid down.

The apparatus of the invention can be built small and lightweight due to the use of a tall pole position to lift light weights only. The example is a mobile unit, but it is contemplated that when needed the reeler and boom can be part of the hydraulic unlimited stroke drive system and built on to a permanent drive unit.

FIGS. 11, 12, 13 and 14 disclose a double drum rig that is used on new installations where tubing must be installed or when converting a well from a sucker rod to a cable drive. The rig of FIGS. 11-14 is capable of doing all work required at the present time in the petroleum industry and in addition is capable of operating with a cable drive system.

As an example, the double drum system of FIGS. 11 through 14 can move in on an abandoned well. It can be used to check the well total depth and clean out the casing with a casing swab if needed. The tubing in the well can be run in the well with the main drum 136. Tubing swabs can be accomplished with the cable system if needed. Thereafter, the rapid fill pump of the type such as seen in FIGS. 4, 5, 6 and 7 herein, along with sinker bars can be installed in the well and thereafter the well placed in production. The equipment as seen in FIGS. 16 through 19 can be left on the well for producing the well or the equipment can be reeled back and taken to a new well location.

The system and equipment of this invention and particularly the unlimited stroke drive system as revealed herein provides for extracting fluid from deeper wells. With all the current artificial lift methods in use in the oil industry today and particularly when the sucker rod plunger pumps are employed, wells of great depth moves most or all fluid of the pump due to rod stretch. Many deep oil and/or gas wells are produced at less than full potential or are abandoned at the well bottom hole pressure and flow decreases to a point that the well cannot lift fluid to the surface.

The petroleum industry, in an effort to pump deep wells, has employed a system using foam to lighten up fluid so as to make production of the fluid possible. Many wells are put on beam pumps and rods just to agitate the fluid and create a fluid/gas interface that will flow to the earth's surface. Deep wells can be swabbed with a cable rig but rigs are limited as to spool sizes versus cable sizes needed to fit on reels and reach the 12,000-18,000 foot depths experienced in some of the deeper production wells. The amount of fluid produced is limited by the small rating of the cables. There is also the danger of wells blowing the lines and tools out of the hole if fluid level is lowered to a point where gas under pressure can unload.

The problem solved by the unlimited stroke drive system of the invention herein are essentially the same as those for shallow wells but the pressures, expenses and potential increase in production are much greater. The rapid fill pump as illustrated in FIGS. 6 and 7 herein eliminates the slippage inherent to all prior art plunger pumps and facilitates loading in the compression chamber of the pump on each stroke. This is critical in deep wells more so than in shallow wells due to the extreme rod stretch which results in over travel and pumping unit gear box torque extremes.

Further, current positive displacement down hole pump systems require more clearance between the plunger and barrel to avoid all the possible drag while reciprocating the plunger. Standard vent hole positive displacement pumps as used in the oil industry rely on an annulus fluid level above the standing valve to overcome the pressured system on the pump's compression chamber. The amount of pressure that must be overcome to open the traveling valve against 12,500 feet or more of hydrostatic fluid weight in the tubing to the earth's surface is tremendous. The invention herein addresses and solves this problem. Unlike pumps that are in current commercial use which must be designed around a given pump unit stroke length and structural size, the improved reciprocated pump system of this invention allows engineers to design the rapid fill pump to meet the volume requirements dictated by the well. Of significant importance is that the rapid fill pump of FIGS. 6 and 7 herein require little or no fluid above the standing valve to fill the compression chamber.

A serious problem with the use of sucker rods to pump an oil well is that the rods, being typically formed of steel, stretch when lifted in the tubing. As an example, if a ⅞" sucker rod string is used to reciprocate a 1½" bore pump at 12,000 feet depth, the rod stroke loss at the pump will be approximately 73", with 24" of the loss being due to tubing stretch. The over travel will be 7" at approximately 4 strokes per minute. On a current reciprocating pumping system utilizing a vertically reciprocating beam the actual down hole stroke movement would be 30" of pump stroke with a 120" surface stroke. Changing the beam unit to compensate for this pump stroke loss is normally not cost effective. Wells sometimes reach a depth with current methods where there is no movement of the pump at all due to rod and tubing stretch at great depths.

The invention herein addresses and solves the problems that exist with present commercially used reciprocated down hole pumps and allows full stroke at the pump and an unprecedented 100% pump loading capacity on each stroke. There is no limit to what depth the system of this invention can accomplish at the pump full stroke combined with the full fill pump system.

By using a cable to replace sucker rods in the pump system of this invention a much quicker and less expensive method to install, operate and repair pumps becomes available. As an example, rods must be transported to a well location in single 25 foot lengths and it can take days to run a string of single rods into a deep well. Further, high strength, heavy equipment is required to handle the large weight of rods. The cost of heavy equipment, rods and pumping make deep wells costs prohibitive especially at depths of 12,500 feet and below. The current technology as used in the oil industry has no capability of producing deep wells with a plunger pump in a cost effective manner. The system of this invention makes it possible to transport the cable to a well location, install a rapid fill pump with sinker bars on a cable of appropriate size for the well depth in a cost effective way. A cable supported pump can be reeled in a well borehole to the seating nipple depth in a matter of minutes versus days for installing sucker rods. The pump is spaced and the cable is attached to the drive cylinder shaft. The drive cylinder is set on the pumping Tee thus eliminating the need for heavy equipment to set a beam pumping unit.

Field tests have shown that when the tubing size and pump plunger size are designed properly a component relationship is created that can be easily adapted to wells of different depths. The hydrostatic weight of fluid in the tubing applies force on a pump plunger that creates an equal condition and the ability to lift fluid at any depth. Whether a well is deep or shallow all that is needed is the weight required to push fluid to the tank. An example, a 12,000 foot well needs no more sinker bars than a 1,200 foot well due to the constant mentioned above. The hydraulic force inherent to the plunger size and weight of the tubing create a zero differential at the pumping Tee.

A new technology development that is particularly useful in the practice of the invention herein is a rope made of synthetic materials such as Kevlar. These ropes have incredible strength, low stretch and low weight. These ropes actually float when submersed within fluid and are impervious to most chemicals and therefore don't suffer from corrosions. As an example, a 1" rope made of material such as Kevlar can have a pull rating of 120,000 pounds with minimal stretch and with no stored energy as a consequence of stretch. Since ropes of this type of synthetic materials do not store energy upon stretching, a rope which is pulled in two does not result in any violent action and contrasts with wire rope. In summary, the use of ropes made of synthetic materials, such as Kevlar, are particularly applicable to the present invention in deep well situations.

Figure 15:
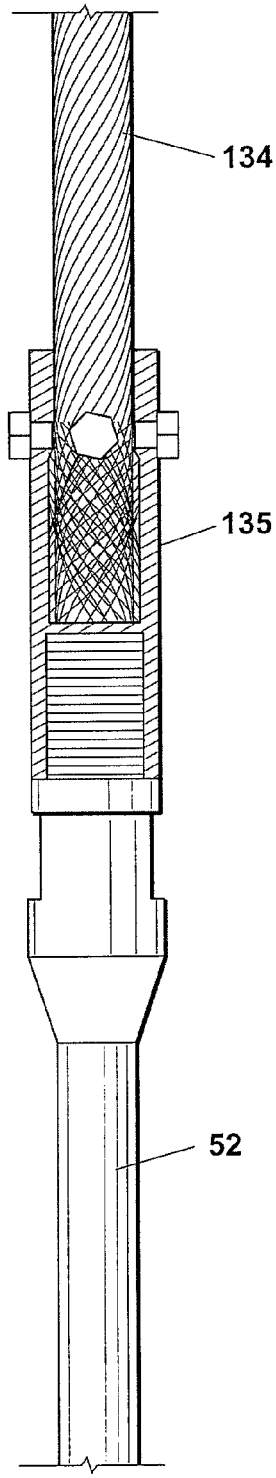
FIG. 15 shows how a flexible cable such as a sand line wire rope which may, as an example, be of ⅝" diameter and how it can be attached to a sucker rod. The system of FIG. 15 permits the attachment of the line to a sucker rod that can be done as a field installation.

FIG. 15 shows how a cable 134 can be secured to the end of a typical sucker rod 52 when required in practicing this invention.

FIGS. 8 through 14 herein show the unique system of this invention utilizing an unlimited stroke drive system in combination with a cable installation machine 130. The installation system includes basic components including the boom 132, cable 134 and cable drum 136 as previously mentioned and in addition thereto can include equipment such as illustrated in FIGS. 16 through 19. The components include such as a hydraulic pump 138, a hydraulic motor 140 for operation of cable drum 136, a hydraulic oil tank 142 that provides a reservoir for the hydraulic system, control valves 144 for controlling the hydraulic system, a solenoid drive cylinder 146, solenoid valve 148, deadline socket 150 used in connection with a deadline 133 for suspending the hydraulic cylinder 20, rod 30, and a portion of the sucker rod string above the wellhead, a rod elevator 151 for continued suspension of the portion sucker rod string 52 above the wellhead 10 after its detachment from the rod 30, solenoid valve pole cylinder 152 and a valve drive cylinder 154. A crown block 156 that has opposed pulleys is supported at the top of boom 132.

Figure 20:
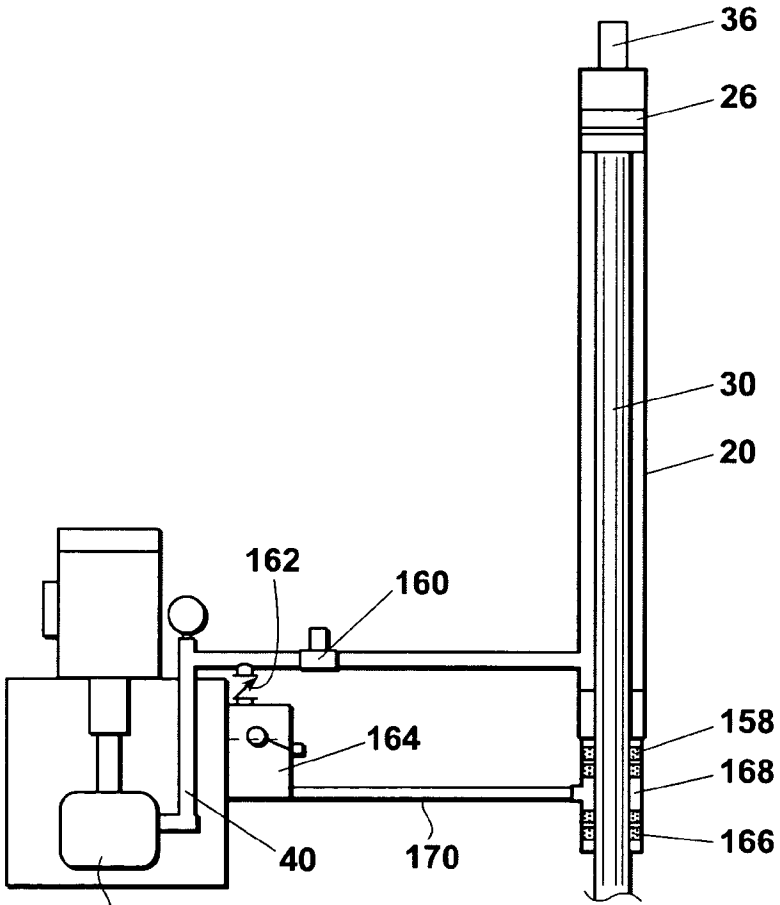
FIG. 20 shows a regenerating pressure seal system for a hydraulic pumping unit polish rod.

Referring now to FIG. 20, a regenerating pressure seal system for a hydraulic pumping unit polish rod is shown. A hydraulic cylinder 20 is shown positioned over an oil well borehole, the borehole not being shown. Reciprocated within cylinder 20 is a piston rod 30 that is sometimes referred to in the petroleum industry as a polish rod. Affixed to the upper end of piston rod 30 is a piston 26. By the application of hydraulic pressure to piston 26 polish rod 30 can be caused to reciprocate up and down. Although not shown, the lower end of polish rod 30 has affixed to it a string of sucker rods or a cable to extend down within tubing to a bottom hole pump in the well.

Secured at a lower end of hydraulic cylinder 20 is an upper seal 158 that surrounds polish rod 30. A function of seal 30 is to separate the hydraulic fluid pressure within cylinder 20 from the outside of the cylinder, such as the crude oil that is pumped upwardly within the well by the reciprocal motion of polish rod 30.

Hydraulic power to reciprocate polish rod 30 is supplied by a hydraulic fluid pump 38, the pressure from the pump passing through pipe 40 and through a solenoid valve 160 into the interior of cylinder 20. By means of a check valve 162 hydraulic pressure from pipe 40 is fed to a high pressure tank 164 which can be in the form of a pipe. Check valve 162 prevents reverse flow through the valve to thereby maintain pressure in tank 164.

Secured about polish rod 30 below upper seal 158 is a lower seal 166. A hydraulic oil cavity 168 is thereby formed between seals 158 and 166. A pipe 170 connects hydraulic pressure from tank 164 to hydraulic oil cavity 168. Thus, hydraulic fluid under pressure is maintained in cavity 168 to constantly apply lubrication to polish rod 30 and lower seal 166 prevents the hydraulic oil from being passed into the crude oil being produced and vice versa, that is, prevents crude oil from contaminating the hydraulic oil that is utilized to vertically translate piston 26 and lubricate polish rod 30.

Figure 21:
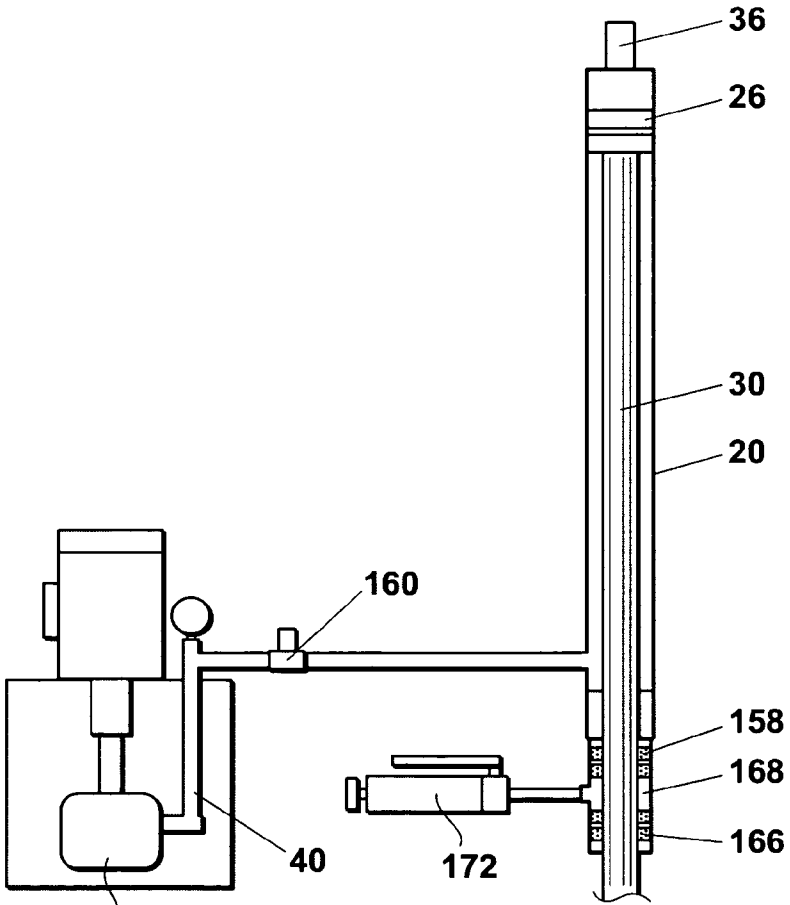
FIG. 21 shows a manual system for supplying grease to a hydraulic pumping system polish rod.

While FIG. 20 illustrates a sophisticated manner in which to maintain lubrication of polish rod 30 and to maintain positive pressure within hydraulic oil cavity 168, FIG. 21 shows a simplified system that can accomplish essentially the same end result, but at substantially less expense, but at the same time however requiring more constant attention and manual labor from an operator. In FIG. 21 cavity 168 is filled with grease supplied from a source of pressurized grease such as supplied by a manually operated grease gun 172. The grease serves the purpose of lubricating piston rod 30 as it is reciprocated. Grease from grease gun 172 form a barrier between the hydraulic oil within cylinder 20 and the crude oil pumped from a well by polish rod 30.

Figure 22:
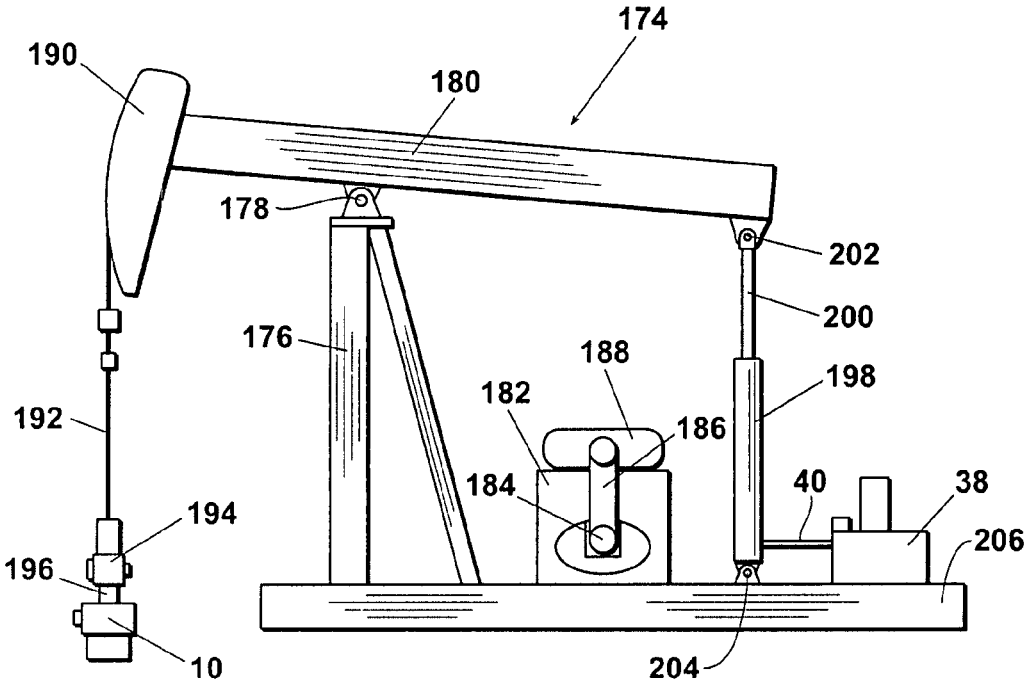
FIG. 22 shows a hydraulic power system applied to a beam pumping unit.

FIG. 22 illustrates how a typical existing beam type pumping unit can be converted for hydraulic operation. This is particularly important since the rapid fill pump of this invention pumped by an unlimited stroke drive is preferably pumped at a long, slow rate which is difficult to achieve with existing beam type pumping units. In FIG. 22, a typical existing beam pumping unit is indicated generally by number 174 and consists of a pumping jack 176 having a block bearing at the top thereof that supports a reciprocal pumping beam 180. Such pumping systems ordinarily employ a gear box 182 that rotates a shaft 184 using, as a source of energy, an electric motor or engine, neither of which are shown. Affixed to shaft 184 is a crank arm 186 having a rotating counterweight 188. Normally, extending from the outer end of crank arm 186 is a Pittman rod (not shown) which connects with pumping beam 180 by which the pumping beam is reciprocated up and down in a vertical plane. At the outer end of pumping beam 180 is horsehead 190 by which a polish rod 192 is vertically reciprocated. Polish rod 192 extends through a stuffing box 194 and is secured to the upper end of a string of tubing 196 which in turn extends from a well head 10.

All of the items mentioned up to this point in describing the mechanism illustrated in FIG. 22 are common in the oilfield for reciprocation of a bottom hole pump using electrical energy or an engine, that is, using a pumping jack with a pivoting beam. FIG. 22 shows a method of modifying the typical beam pumping unit 174 to provide complete control for a rapid fill pump that has been described in an earlier part of this application. In order to move a rapid fill pump in a long stroke at a slow speed that is typically desirable, especially when pumping at low production or stripper well, the components to connect the crank arm 186 to pumping beam 180 are removed and actuation of beam 180 is achieved by use of a hydraulic cylinder 198. Extending from the top of the hydraulic cylinder is piston rod 200 connected by a bearing 202 to an outer end of the pumping beam 180. The lower end of hydraulic cylinder 198 is connected by a bearing 204 to a pumping unit base 206. By means of a hydraulic pump 38 and a control system such as that described with respect to FIG. 1, the reciprocation of beam 180 can be operated at a slow rate so that the polish rod 192 and a sucker rod string or cable connected at the lower end thereof that extends down to a down hole pump can be vertically reciprocated at a desirable slow rate to pump well fluid with the least expenditure of energy. The system of FIG. 22 can be effectively used when converting a standard beam type pumping unit to use with a unlimited stroke drive system of this invention. The conversion cost is a relatively small cost compared to the cost frequently experienced in maintaining a mechanical drive pumping system.

Figure 23:
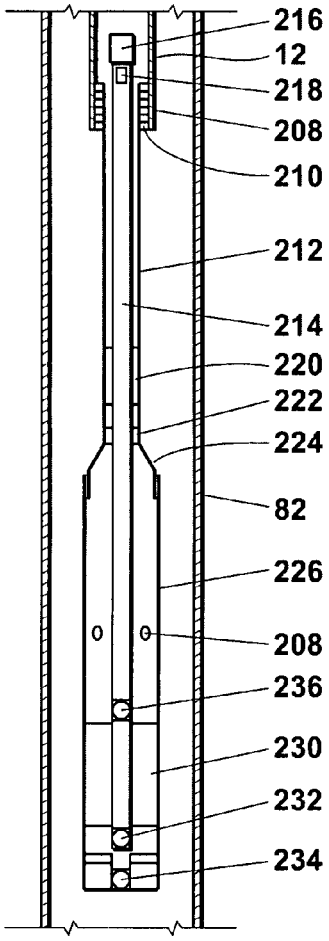
FIG. 23 shows a down hole light lift gas vent pumping system.

Turning now to FIG. 23 there is disclosed a downhole light lift gas vent pumping system that is positioned within casing 82. The pumping system is secured to the bottom end of a string of tubing 12. In the lower end of tubing 12 is a seating nipple 208 and a hold down 210. The seating nipple and hold down provide for receiving a 1½" pump barrel 212. Received within pump barrel 212 is a plunger tube 214. Affixed to the upper end of plunger tube 214 is an on/off tool 216 that has below it a pull rod adaptor 218.

Secured to the plunger tube 214 is a 1¼" cup or ring plunger 220. Also received at the lower end of plunger tube 214 is a perforated coupling 222 and attached to it is a 1½" to 2¾" change over 224.

Secured to the change over 224 is a 2¾" gas vent tubing pump barrel 226. The 2¾" gas vent tubing pump barrel 226 has typically a 48" fluid stroke. Further the gas vent tubing pump barrel 226 has gas vent ports 228 therein.

Secured to plunger tube 214 is a 2¾" metal tubing pump plunger 230 that carries with it a traveling valve 232. Received in the lower end of 2¾" gas pump barrel 226 is a standing valve 234.

Received within the plunger tube 214 above the 2¾" metal tubing pump plunger 230 is an upper traveling valve 236. Further, the 2¾" gas vent pump barrel 226 has at least one, but preferably a plurality of gas vent ports 228. The downhole light lift gas vent pumping system of FIG. 23 uses the rapid fill concept, as has been previously described. The upper 1¼" cup or ring plunger 220 is, as has been described, typically a cup plunger whereas the lower plunger 230 is typically a metal plunger. The pumping system of FIG. 23 requires reduced horsepower compared to previous pumping systems and experience has shown that the pumping system of FIG. 23 produces a pumping load that remains the same as for a 1½" pump.

To pump the system of FIG. 23 sucker rods are run within tubing 12 that have, on the lower end thereof and not seen in FIG. 23, an on-off tool attachment that releasably attaches to the on and off tool 216. Thus by running a string of sucker rods within tubing 12 attachment can be made by use of on-off tool 216 to vertically reciprocate plunger tube 214 and thereby provide the volume benefits of a 2¾" gas vent pump barrel, such as barrel 226 as shown in FIG. 23.

As shown in FIG. 23 the 1¼" cup or ring plunger 220 seals the interior of the 1½" pump barrel 212 which, in turn, is sealed to the interior of tubing 12, while the metal plunger 232 and valves 236 in association therewith are in the rapid fill tubing pump. When needed the perforated coupling 222 relieves the pressure between the upper plunger 220 and the lower plunger 230 on the pump upstroke.

Figure 24:
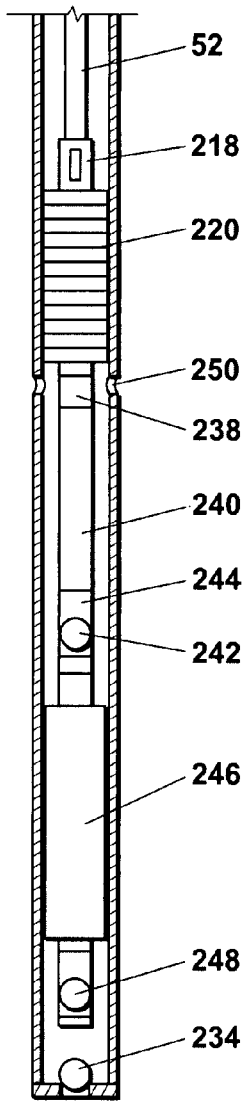
FIG. 24 shows a rapid fill pump particularly adapted for long stroke pumping.

Turning now to FIG. 24, a rapid fill pump particularly adapted for long stroke pumping is diagrammatically illustrated. In FIG. 24, a pump barrel 212 has therein an upper cup or ring plunger 220 that is attached to a pull rod adapter 218 which in turn is secured to the lower end of a string of sucker rods 52.

Below the cup or ring plunger 220 is a plunger tube adapter 238 that secures a plunger tube extension 240. Secured to the lower end of plunger tube extension 240 is an upper traveling valve, consisting of the ball and seat that is contained within a valve case 244.

Positioned below the upper traveling valve case 244 is a metal plunger 246 and below it a lower traveling valve 248. Barrel vent ports 250 provide means for rapidly filling the pump as has been previously described with reference to earlier embodiments.

The pump of FIG. 24 can typically accommodate a 48" pump stroke in a system in which the cup plunger 220 is about 2' long, the plunger extension 240 is about 40" long and the metal plunger 246 is about 2' long.

The cup plunger 220 must remain above vent ports 250 on the bottom of each down stroke of sucker rods 52. The use of the plunger tube extension 240 provides a pumping system that is much more economical to use where only a 2' long plunger 246 is required compared to the typical pump that would otherwise use a 4' long metal plunger.

A longer pump such as a 120" pump requires a longer plunger tube 240 and a longer pump barrel 212 so as always to keep the upper cup plunger 220 above the barrel vent ports 250.

Figure 25:
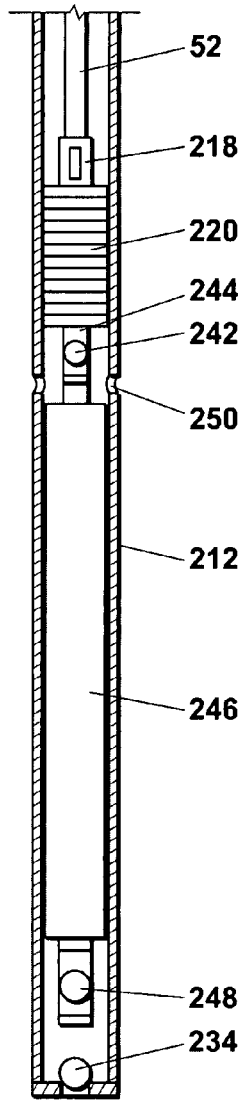
FIG. 25 shows a pump as in FIG. 24 with a relatively shorter plunger tube extension and a longer metal plunger.

Referring now to FIG. 25, a pump is shown that is similar to the pump of FIG. 24. Specifically in the pump arrangement of FIG. 25 a plunger tube extension is not required and metal plunger 246 is relatively longer.

Comparing specifically FIGS. 24 and 25, it is seen that the cup or ring plunger 220 is about the same in both figures and that the pump barrel 212 is about the same length, however, in FIG. 25 metal plunger 246 is much longer. In FIG. 25 the plungers 220 and 246 are connected essentially by a valve case 244 so that thereby plunger tube extension is not required in FIG. 25.

In the arrangement of FIG. 25 as with FIG. 24, it is important that upper cup plunger 220 does not go below barrel vent ports 250 at the bottom end of the down stroke of sucker rods 52.

Comparing FIGS. 24 and 25 the primary difference is the economy of construction of FIG. 24 that uses a relatively shorter length metal plunger 246 and a longer length plunger tube extension 240 as a substitute for the long metal plunger 246 of FIG. 25. Otherwise the pumps as shown in FIGS. 24 and 25 function in exactly the same way for the same benefits.

Figure 26:
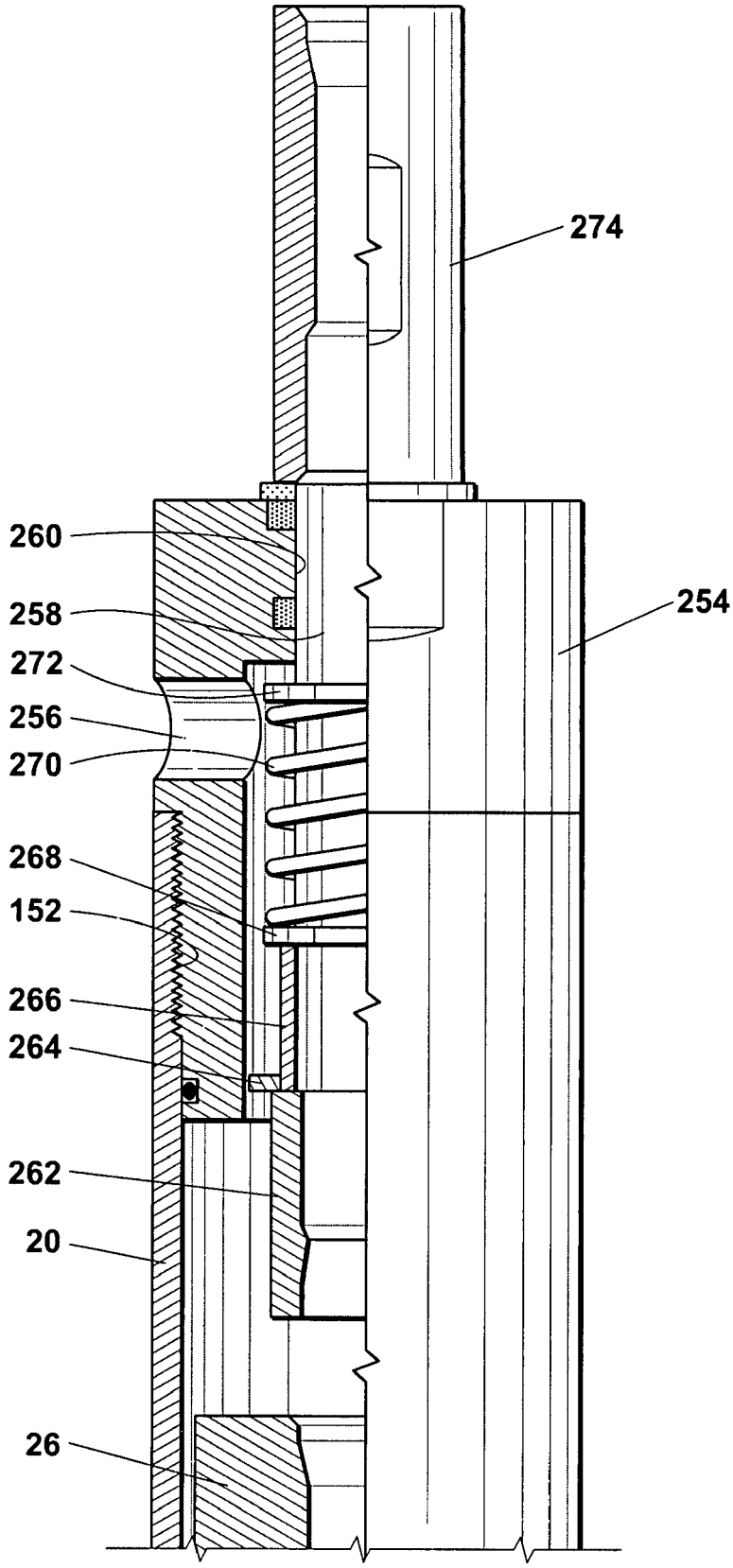
FIG. 26 shows details of the upper end of a hydraulic pumping system showing particularly a top of stroke indicator and lifting pin.

In FIG. 26 the upper end of a hydraulic pumping cylinder 20 is shown having affixed thereto a top of stroke indicator and a lifting pin. The upper end of hydraulic cylinder 20, such as cylinder 20 in FIGS. 1, 2, 4, 5, 20 and 21, is shown with internal threads 152. Received within threads 152 is a top of stroke end gland 254 that has a fluid return port 256 therein. A conduit (not shown) is normally connected to return port 256 by which hydraulic fluid used to move piston 26 within cylinder may be returned to a fluid reservoir. However return port 256 does not necessarily carry fluid under hydraulic pressure since hydraulic pressure is not required to move piston 26 downwardly. A shaft 258 is received within an opening 260 in the top of stroke end gland 254.

A collar 262 is threaded onto the lower end of shaft 258. An enlarged diameter washer 264 is received on shaft 258. By means of a sleeve 266 force can be applied to a washer 268 that has positioned there above a coil spring 270. When hydraulic cylinder 20 is moved upwardly by force of hydraulic fluid within piston 26, piston 26 engages collar 262 and thereby moves shaft 258 upwardly. A top washer 272 above spring 270 engages an interior top ledge of top of stroke end gland 254. This spring 270 applies a restraining force to the upward movement of piston 26. Shaft 258 is upwardly displaced and this displacement can be used to provide a signal of the top of the stroke of piston 26. By means of a valve or other control device (not shown) acted on by the upward displacement of shaft 258 a signal can be employed to terminate the upward movement of piston 26.

The upper end of shaft 258 is provided with a ¾" rod coupling 274. This provides an easy way for attachment of a lifting mechanism that can be used to lift the entire cylinder 20 either when installing a hydraulically actuated pumping unit or for replacement or repairs.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claims, including the full range of equivalency to which each element thereof is entitled.

What is claimed is:

1. An installation system for use with an oil well, the oil well having a length of tubing extending downwardly from a wellhead into a crude oil producing formation, a down-hole pump positioned within a lower end of the tubing by which crude oil can be pumped up the tubing and to the earth's surface via vertical reciprocation of a sucker rod string, the installation system including a hydraulic cylinder located above the wellhead and resting on a flow tee and having a polish rod extending downward into said flow tee and connected to said sucker rod string, the installation system comprising:

an installation machine;

a boom mounted on the installation machine and moveable between a first and a second vertical position;

a hydraulic control system in communication with the boom;

a pulley located at an upper end of the boom;

a cable having a first end extending over the pulley and connectable to the hydraulic cylinder and having a second end being connectable to the installation machine;

means for suspending a portion of the sucker rod string above the flow tee of the wellhead and allowing suspension of the hydraulic cylinder above the flow tee and detachment of the polish rod from the sucker rod string, the hydraulic cylinder and portion of the sucker rod string being lifted above the flow tee when the boom moves between said first and second vertical positions.

2. An installation system according to claim 1 wherein said installation machine is moveable between a first and a second well location, the boom being in a horizontal position during transport of the installation machine between said well locations.

3. An installation system according to claim 1, wherein said hydraulic control system is in communication with said hydraulic cylinder and reciprocating said sucker rod string and said down-hole pump when said boom is said vertical position.

4. An installation system according to claim 1, wherein said down-hole pump moves between a seated and an unseated position as said boom moves between said first and second vertical positions.

5. An installation system according to claim 1 wherein said sucker rod string is a continuous rod string, the continuous rod string when in a detached state from said polish rod having an upper end extending over the pulley and being received by a powered reel located on the installation machine, the powered reel winding the continuous rod string about the reel, thereby reeling the down-hole pump upward and out of the well tubing.

6. An installation system according to claim 5 wherein said continuous rod string is a fiberglass rod string.

7. An installation system according to claim 5 wherein said boom is extendable to a third vertical position to accommodate removal of said down-hole pump from the well tubing.

8. An installation machine according to claim 1 wherein said means for suspending a portion of the sucker rod string above the flow tee of the wellhead and allowing suspension of the hydraulic cylinder above the flow tee and detachment of the polish rod from the sucker rod string is a deadline secured to a deadline socket.

9. An installation system according to claim 1 further comprising means for continued suspension of said portion of the sucker rod string above the wellhead after said sucker rod string has been detached from said polish rod when said hydraulic cylinder and said polish rod are suspended above the wellhead.

10. An installation system according to claim 9 wherein said means for continued suspension of said portion of the sucker rod string is a rod elevator.

* * * * *